US011459810B1

(12) United States Patent
Smith

(10) Patent No.: US 11,459,810 B1
(45) Date of Patent: Oct. 4, 2022

(54) CABLE RECOIL DEVICE

(71) Applicant: Sub-Zero Group, Inc., Madison, WI (US)

(72) Inventor: Terence Thomas Smith, Lake Mills, WI (US)

(73) Assignee: Sub-Zero Group, Inc., Madison, WI (US)

( * ) Notice: Subject to any disclaimer, the term of this patent is extended or adjusted under 35 U.S.C. 154(b) by 448 days.

(21) Appl. No.: 16/596,834

(22) Filed: Oct. 9, 2019

(51) Int. Cl.
*E05D 11/00* (2006.01)
*F25D 23/02* (2006.01)

(52) U.S. Cl.
CPC ..... *E05D 11/0081* (2013.01); *E05D 11/0054* (2013.01); *F25D 23/028* (2013.01); *E05Y 2900/31* (2013.01); *F25D 2323/024* (2013.01)

(58) Field of Classification Search
CPC ..... E05D 11/0081; E05D 11/0054; F25D 23/028; F25D 2323/024; E05Y 2900/31
See application file for complete search history.

(56) References Cited

U.S. PATENT DOCUMENTS 1,876,192 A * 9/1932 Wolters ..... E05G 1/024 109/70
2,295,689 A * 9/1942 Renton ..... E06B 3/44 49/458
3,018,507 A * 1/1962 Launer ..... E06B 3/4609 160/90
4,003,102 A * 1/1977 Hawks ..... E05F 1/025 49/404
4,640,049 A * 2/1987 Duncan ..... E05D 13/1223 267/74
8,393,691 B2 * 3/2013 Diebold ..... A47L 15/4261 312/319.1
2004/0113531 A1 * 6/2004 Raches ..... A47L 15/4261 312/319.2
2007/0283524 A1 * 12/2007 Gordon ..... E05F 1/16 16/78
2011/0215691 A1 * 9/2011 Keskin ..... E05F 1/1075 312/319.2
2011/0241507 A1 * 10/2011 Diebold ..... A47L 15/4261 312/328
2014/0375192 A1 * 12/2014 Haft ..... E05D 13/1207 49/386
2019/0000295 A1 * 1/2019 Klusek ..... A47B 96/00
2021/0095508 A1 * 4/2021 Czarnota ..... E05F 1/1075

* cited by examiner

*Primary Examiner* — Justin B Rephann
(74) *Attorney, Agent, or Firm* — Bell & Manning, LLC

(57) ABSTRACT

A cable recoil device includes a cable recoil device body, a pulley, a pulley yoke, a spring, and a cable. The pulley yoke is mounted to the pulley that is positioned within the cable recoil device body and has a wheel shaped body. The spring is connected to the cable recoil device body and to the pulley yoke. The cable is wound at least partially around a circumference of the wheel shaped body. When the cable recoil device is mounted for use in a device, the first end of the cable is connected to a body of the device and the second end of the cable is connected to a door of the device that moves relative to the body of the device. The spring provides tension on the pulley such that it lengthens when the door is opened and contracts when the door is closed.

20 Claims, 21 Drawing Sheets

CABLE RECOIL DEVICE

BACKGROUND

Doors of all kinds are mounted to hinges for rotational opening and closing of the doors, while other doors are slid open. For example, a refrigerator door may be mounted to a hinge, which is mounted to a body of a refrigerator to allow the door to rotate open and closed under control of the hinge. Various types of cables may be connected between a body to which the door is mounted and the door itself. For example, an electrical cable may carry an electrical current or an electrical signal from a location in the refrigerator body to a location in the refrigerator door, or a cable may carry water from a location in the refrigerator body to a location in the refrigerator door. The cable, however, can interfere with the opening and closing of the door or be compressed by the door in an undesirable manner.

SUMMARY

In an example embodiment, a cable recoil device is provided that includes, but is not limited to, a cable recoil device body, a pulley, a pulley yoke, a spring, and a cable. The pulley is positioned within the cable recoil device body and has a wheel shaped body. The pulley yoke is mounted to the pulley. The spring is positioned within the cable recoil device body and has a first end and a second end. The first end of the spring is connected to the cable recoil device body, and the second end of the spring is connected to the pulley yoke. The cable has a first end and a second end and is wound at least partially around a circumference of the wheel shaped body of the pulley. When the cable recoil device is mounted for use in a device, the first end of the cable is configured to be connected to a body of the device and the second end of the cable is configured to be connected to a door of the device that moves relative to the body of the device. The spring is configured to provide a tension on the pulley such that the spring lengthens when the door of the device is opened and contracts when the door of the device is closed.

In another example embodiment, a cable assembly is provided that includes, but is not limited to, the cable recoil device, a first connector, a second connector, and a cable body connector. The cable body connector includes, but is not limited to, a connector cable aperture wall, wherein the cable is inserted through the connector cable aperture wall. The first connecter is mounted to the first end of the cable that extends from a first side of the cable body connector. The second connecter is mounted to the second end of the cable that extends from a second side of the cable body connector opposite the first side. The first connecter is mounted to the body of the device so that the first connector does not move relative to the body of the device when the door of the device is opened. The second connecter is mounted to the cable recoil device body so that the second connector does not move relative to the cable recoil device body when the door of the device is opened.

In another example embodiment, a device is provided that includes, but is not limited to, a door, a body, the cable recoil device mounted to the door, the first connector, the second connector, and the cable body connector mounted to the body. The door is mounted to the body to move relative to the body.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
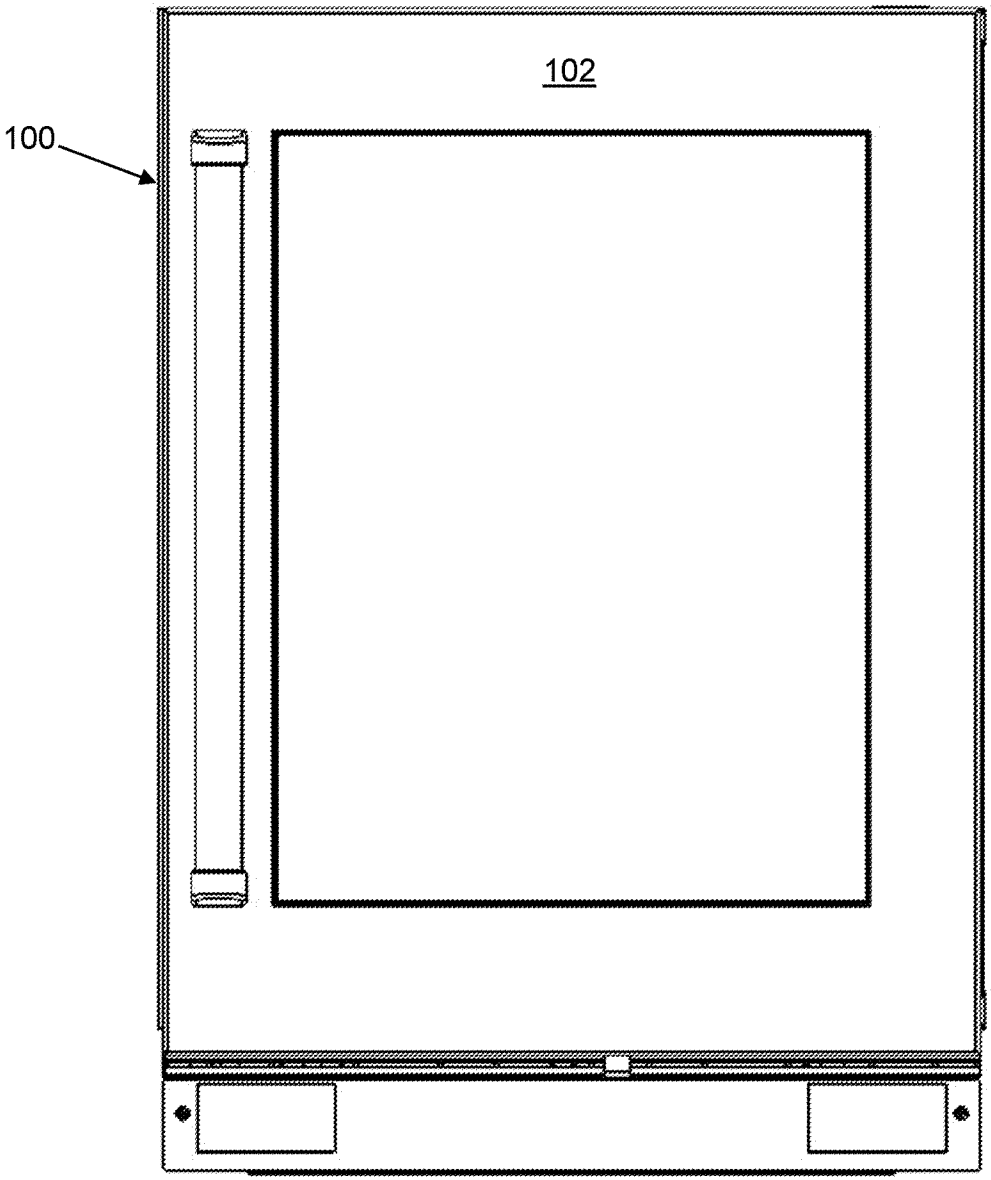
FIG. 1 depicts a front view of a device in accordance with an illustrative embodiment.
Figure 2A:
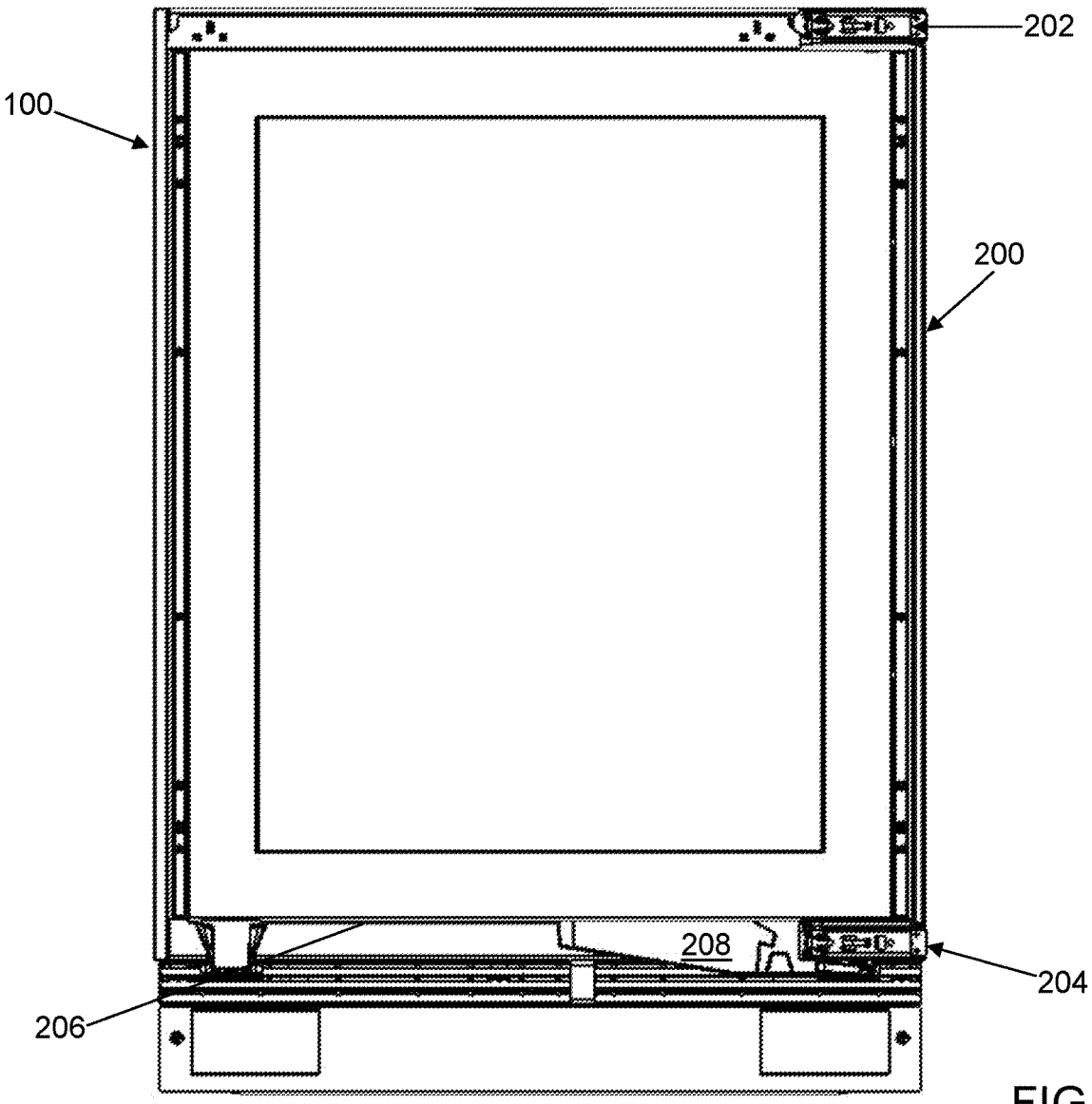
FIG. 2A depicts a front view of the device of FIG. 1 with a door panel removed in accordance with an illustrative embodiment.
Figure 2B:
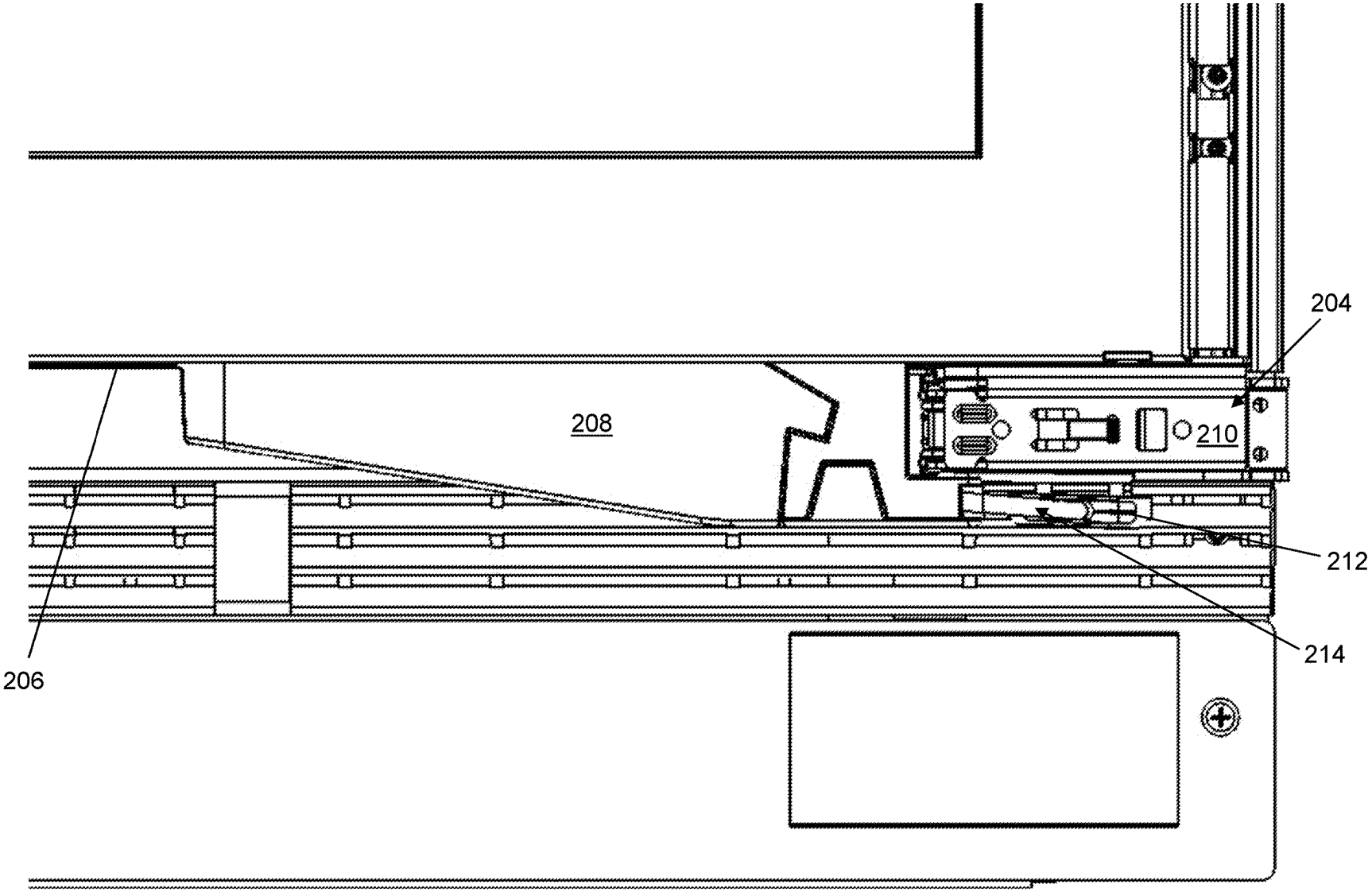
FIG. 2B depicts a front view of the device of FIG. 1 with the door panel removed and zoomed to show a bottom hinge in accordance with an illustrative embodiment.
Figure 3A:
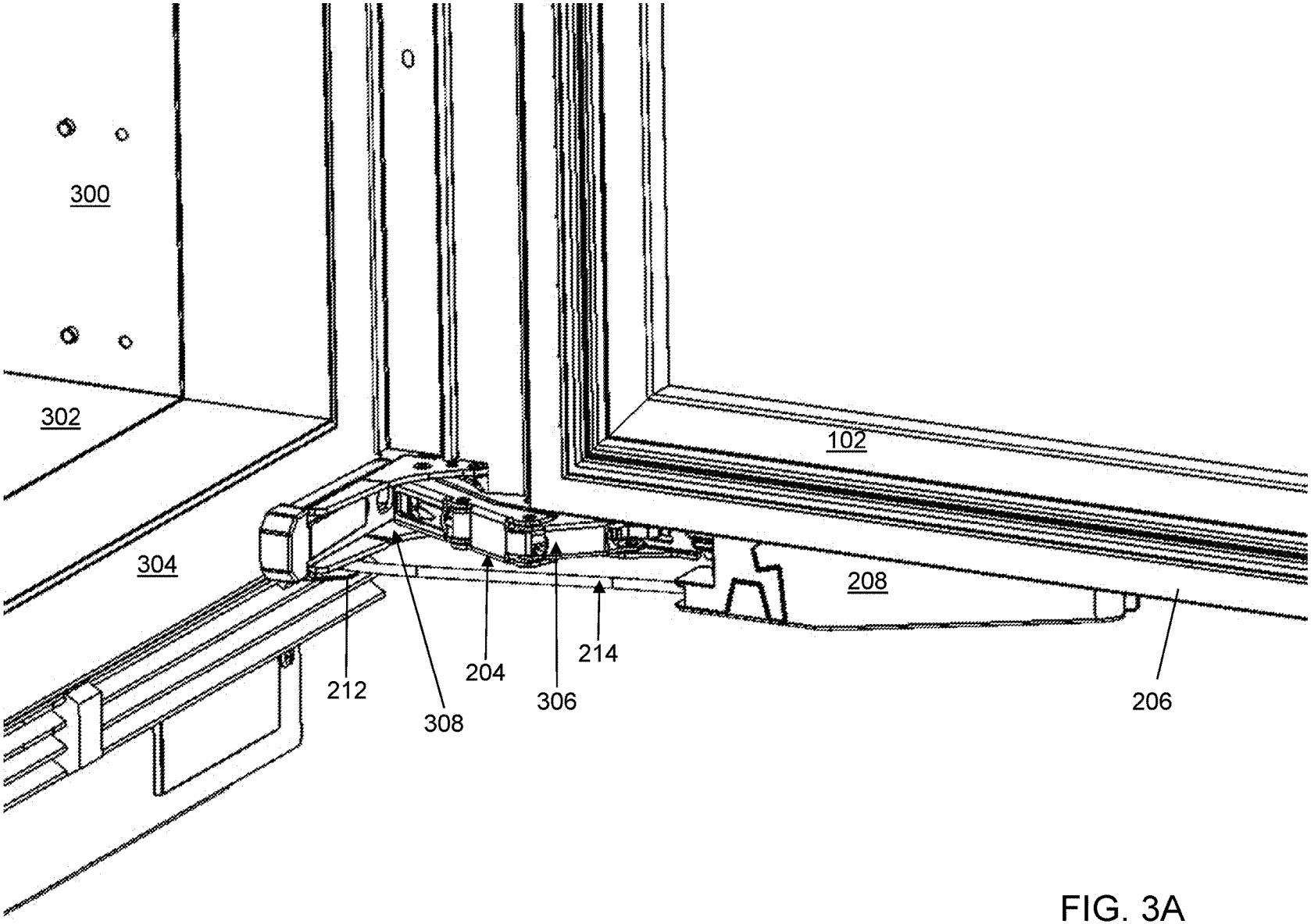
FIG. 3A depicts a front perspective view of the device of FIG. 1 with a door in a fully open position and zoomed to show the bottom hinge and a cable recoil device in accordance with an illustrative embodiment.
Figure 3B:
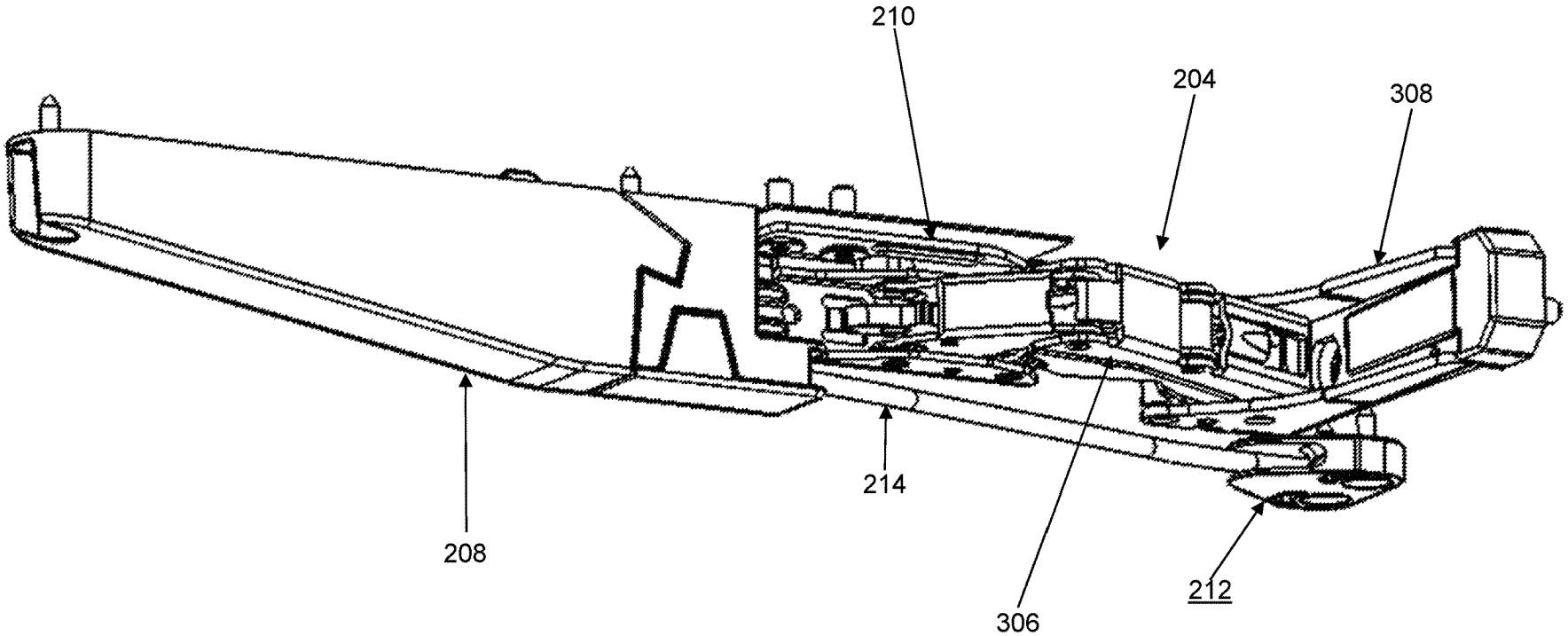
FIG. 3B depicts a right side perspective view of the cable recoil device of FIG. 3A with the door in an open position that opens to the left in accordance with an illustrative embodiment.
Figure 4:
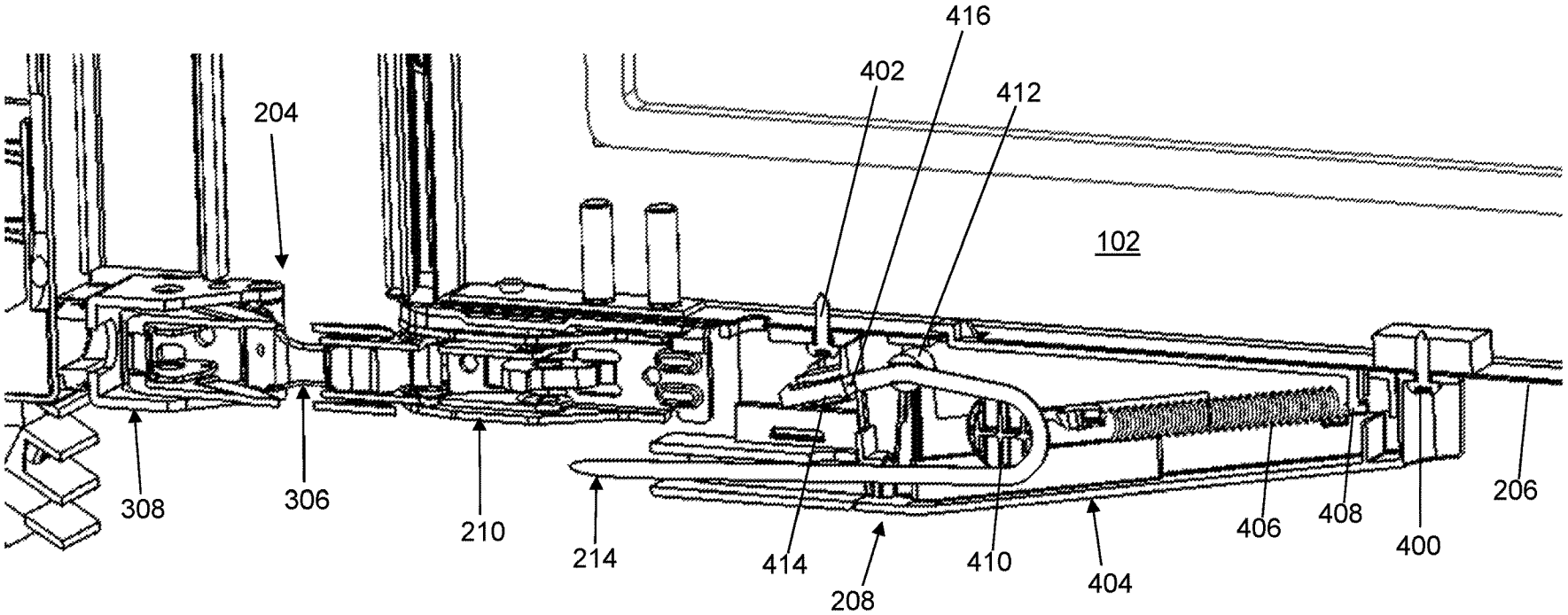
FIG. 4 depicts a front perspective, cross-sectional view of the device of FIG. 1 with the door in the open position and zoomed to show the bottom hinge and the cable recoil device in accordance with an illustrative embodiment.

With reference to FIG. 1, a device 100 is shown in accordance with an illustrative embodiment. With reference to FIG. 2A, a front view of device 100 is shown with a door panel removed in accordance with an illustrative embodiment. With reference to FIG. 2B, a front view of device 100 with the door panel removed is zoomed to show a bottom hinge 204 in accordance with an illustrative embodiment. With reference to FIG. 3A, a front perspective view of device 100 is shown with a door 102 in an open position and zoomed to show a bottom hinge 204 and a cable recoil device 208 in accordance with an illustrative embodiment. With reference to FIG. 3B, a right side perspective view of cable recoil device 208 is shown with door 102 in the open position though door 102 has been removed to show the mounting relationship between bottom hinge 204 and cable recoil device 208 for a left opening door 102 in accordance with an illustrative embodiment. With reference to FIG. 4, a front perspective, cross-sectional view of device 100 is shown with door 102 in the open position and zoomed to show bottom hinge 204 and cable recoil device 208 in accordance with an illustrative embodiment.

Device 100 may include body 200, door 102, a top hinge 202, bottom hinge 204, cable recoil device 208, a cable body connector 212, and a cable 214. In the illustrative embodiment, device 100 includes door 102 with two hinges to support rotation of door 102 away from body 200 to provide access to an enclosed space defined by body 200. In alternative embodiments, device 100 may include a greater or a fewer number of doors and/or hinges with the hinges placed in various locations relative to door 102 and body 200. For example, door 102 may open up, may open down, may open to the right, or may open to the left.

Merely for illustration, door 102 provides access to a cooled space such as a refrigerator, a freezer, a wine cooler, etc. though device 100 may be any device that includes door 102 and body 200 of any shape or size. In the illustrative embodiment, door 102 rotates relative to body 200 though door 102 further may move in other manners relative to body 200 to provide access to the enclosed space defined by body 200. For example, door 102 may slide relative to body 200 in any direction.

Body 200 may include a plurality of walls such as a top wall (not shown), a bottom wall 302, a right sidewall 300, a left sidewall (not shown), and a back wall (not shown) that define the enclosed space. However, device 100 need not define an enclosed space and may include a fewer or a greater number of walls. Though shown in the illustrative embodiment as forming a generally rectangular shaped enclosure, device 100 may form any shaped enclosure including other polygons as well as circular or elliptical enclosures. As a result, door 102 and the walls forming body 200 may have any shape including other polygons as well as circular or elliptical shapes.

In the illustrative embodiment, door 102 is rotationally mounted to body 200 of device 100 using top hinge 202 and bottom hinge 204. Top hinge 202 mounts a top surface of door 102 to the top wall of device 100. Bottom hinge 204 mounts a front face 304 of bottom wall 302 to a bottom surface 206 of door 102 though either hinge can mount to other surfaces of body 200 or door 102.

Referring to FIGS. 3A and 3B, bottom hinge 202 may include a door section 210 mounted to bottom surface 206 of door 102, an articulating section 306, and a body section 308 mounted to front face 304 of bottom wall 302. Articulating section 306 is connected between door section 210 and body section 308. Articulating section 306 may include one or more joints that allow door 102 to rotate relative to body 300 to provide access to the enclosed space defined by body 200. Bottom hinge 202 may have various designs that are generally known to support the rotational movement of door 102 relative to body 200.

In the illustrative embodiment, cable body connector 212 is mounted adjacent body section 308 of bottom hinge 204. More specifically, in the illustrative embodiment, cable body connector 212 is mounted below body section 308 and to body section 308 though this is not required. For example, cable body connector 212 may be mounted to other surfaces of body 200 and/or adjacent to top hinge 202.

Cable 214 is connected on a first end 602 (shown referring to FIG. 6) to a first connector 608 (shown referring to FIG. 6) that is connected to a first component (not shown) of device 100 located in or on body 200 and on a second end 416 to a door cable connector 414 that is connected to a second component (not shown) in or on door 102. Intermediate cables may further connect between door cable connector 414 and the second component and/or between first connector 608 and the first component.

Cable 214 may have a circular cross section though other cross section shapes may be used in alternative embodiments including elliptical or polygonal. Cable 214 may have various lengths based on a connectivity distance between and within cable body connector 212 and cable recoil device 208 and a distance of movement between door 102 and body 200.

Cable 214 may have various diameters based on a medium contained within cable 214 and any protective materials used to form cable 214. For example, cable 214 may carry an electrical current, a fluid such as water or a gas, an electrical signal, etc. Cable 214 further may carry a plurality of the same or different media between body 200 and door 102. For example, cable 214 may carry an electrical current between a control board located in body 200 and a user interface located on door 102, and/or water between an external water source connected to body 200 and a water dispenser located in door 102. As a result, cable 214 may connect a plurality of first components with one or more second components.

Cable recoil device 208 may include recoil device body 404, a spring 406, a pulley yoke 504, a pulley 410, and a cable sheath 412. In the illustrative embodiment, cable recoil device 208 is mounted adjacent door section 210 of bottom hinge 204 to move with door 102 when door 102 is moved relative to body 200 though cable recoil device 208 can be mounted in other locations. Cable 214 is wound through cable body connector 212 and cable recoil device 208 so that cable recoil device 208 controls movement of cable 214 consistently and reliably to avoid pinching cable 214 and makes cable 214 less noticeable to and less likely to be inadvertently contacted by a user of device 100.

Cable body connector 212 and cable recoil device 208 may be mounted relative to any two objects that move relative to each other and that which use cable 214 between the first component located in the first object and the second component located in the second object. Body 200 and door 102 are merely for illustration. Body 200 and door 102 further may move relative to each other different distances based on the application.

Figure 5A:
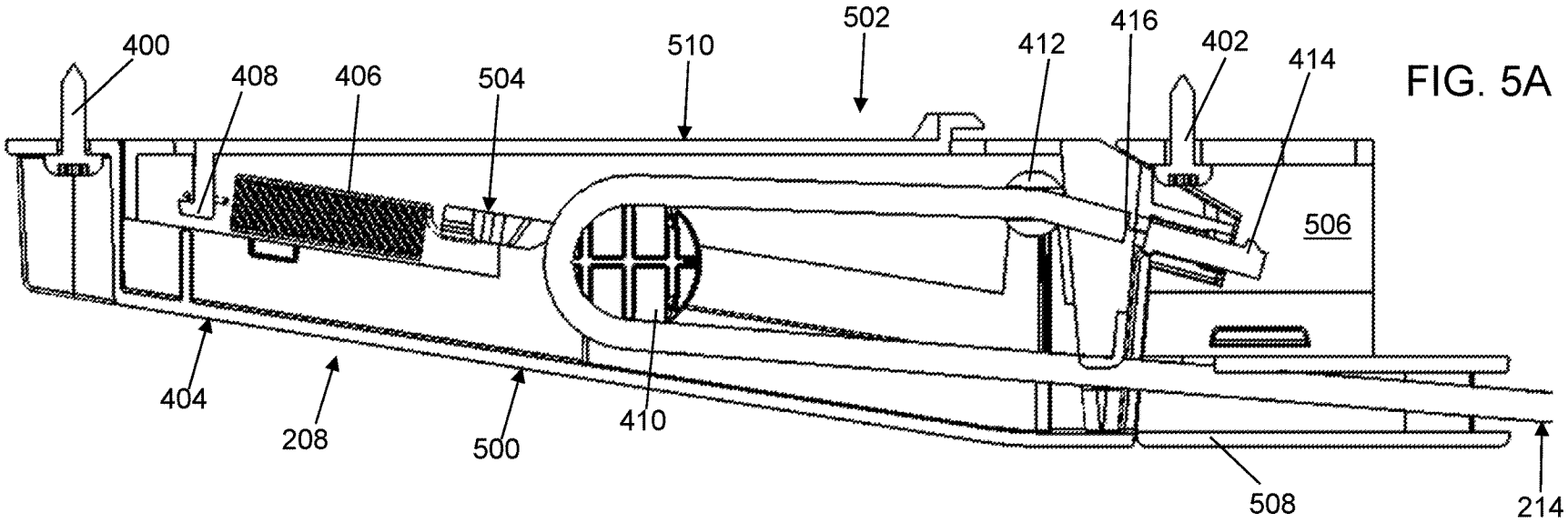
FIG. 5A depicts a right side cross-sectional view of the cable recoil device of FIG. 3 with the door in a closed position in accordance with an illustrative embodiment.
Figure 5B:
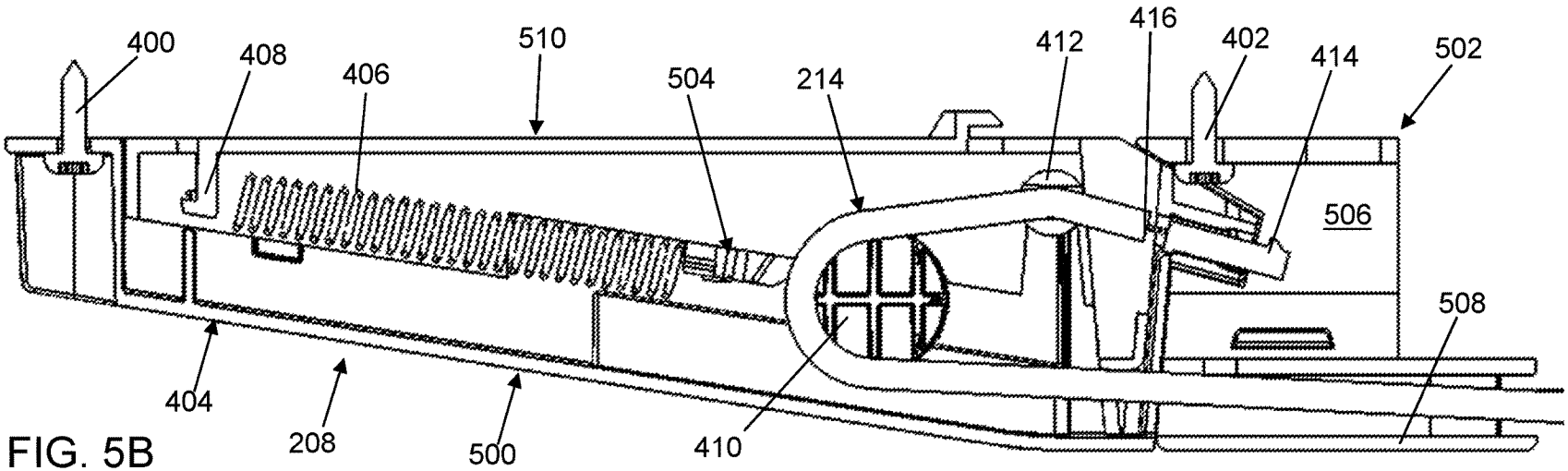
FIG. 5B depicts a right side cross-sectional view of the cable recoil device of FIG. 3 with the door in the open position in accordance with an illustrative embodiment.

With reference to FIG. 5A, a right side cross-sectional view of cable recoil device 208 is shown with door 102 in a closed position in accordance with an illustrative embodiment. With reference to FIG. 5B, a right side cross-sectional view of cable recoil device 208 is shown with door 102 in the open position in accordance with an illustrative embodiment. Recoil device body 404 may include a bin 500, cover 502, a housing cap 506, and a cap floor piece 508. A first fastener 400 mounts bin 500 to door 102, and a second fastener 402 mounts housing cap 506 to door 102. First fastener 400 and second fastener 402 may the same or different type of fasteners that may include a screw, a rivet, a pin, adhesive, etc. Bin 500 and cover 502 form a housing 510 for internal components of cable recoil device 208. Housing cap 506 and cap floor piece 508 house cable 214 between housing 510 and cable body connector 212.

Figure 6:
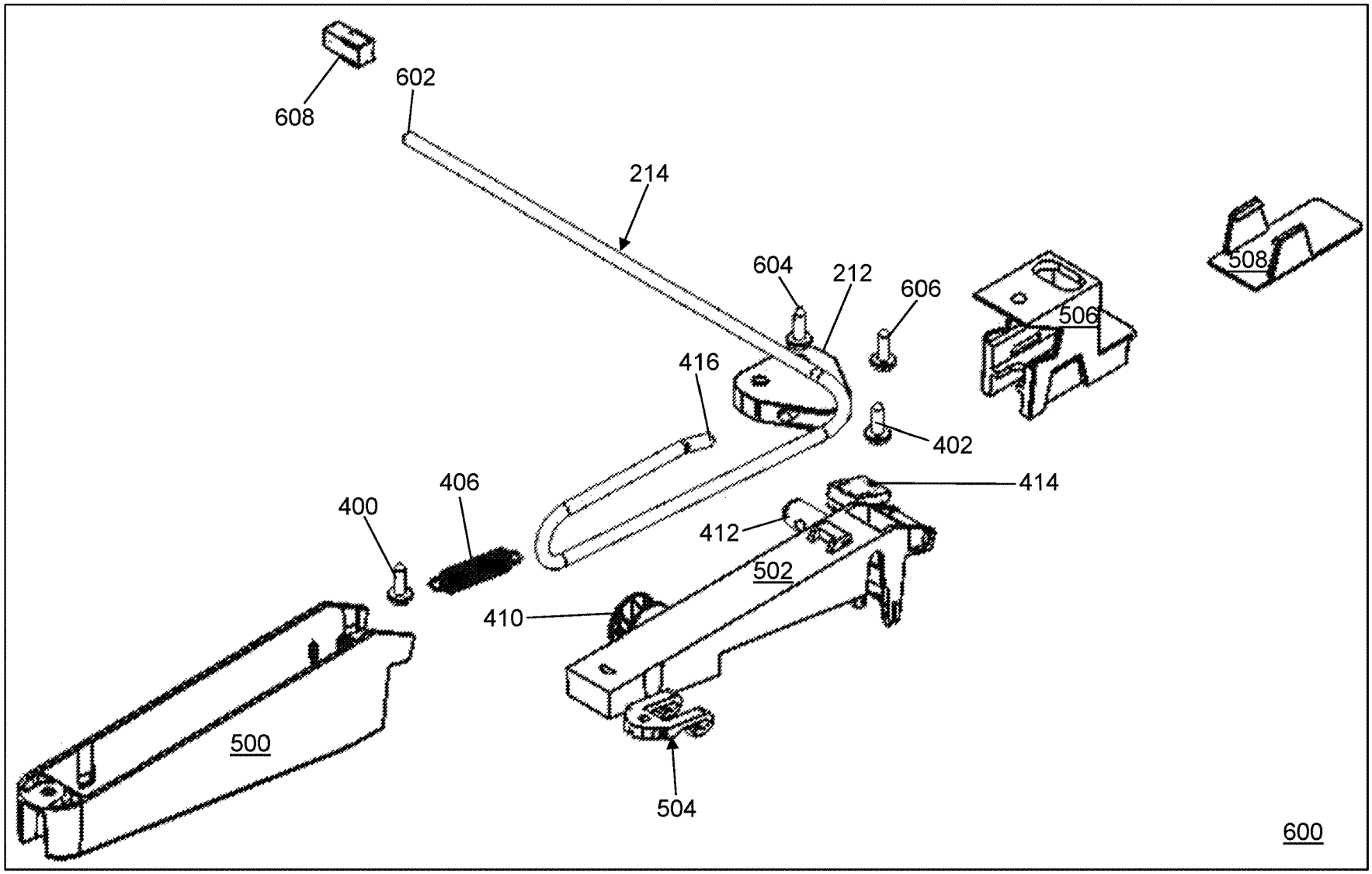
FIG. 6 depicts a top exploded view of a cable assembly in accordance with an illustrative embodiment.

With reference to FIG. 6, a top exploded view is shown of a cable assembly 600 in accordance with an illustrative embodiment. Cable assembly 600 may include cable recoil device 208 and cable body connector 212. A third fastener 604 and a fourth fastener 606 mount cable body connector 212 to body 200. Third fastener 604 and fourth fastener 606 may the same or different type of fasteners that may include a screw, a rivet, a pin, adhesive, etc.

Figure 7A:
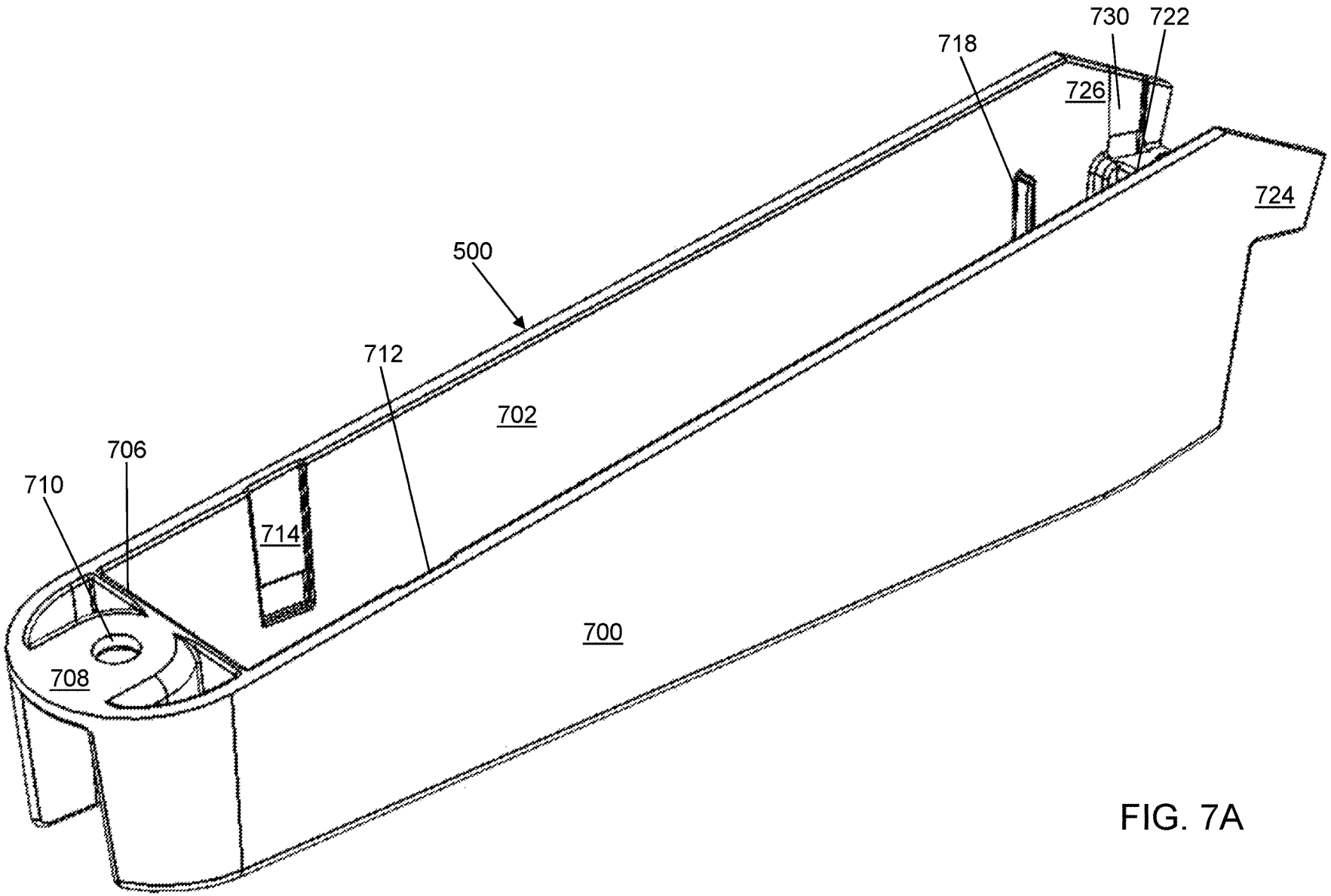
FIG. 7A depicts a right side perspective view of a bin of a recoil device body of the cable recoil device of FIG. 3 in accordance with an illustrative embodiment.
Figure 7B:
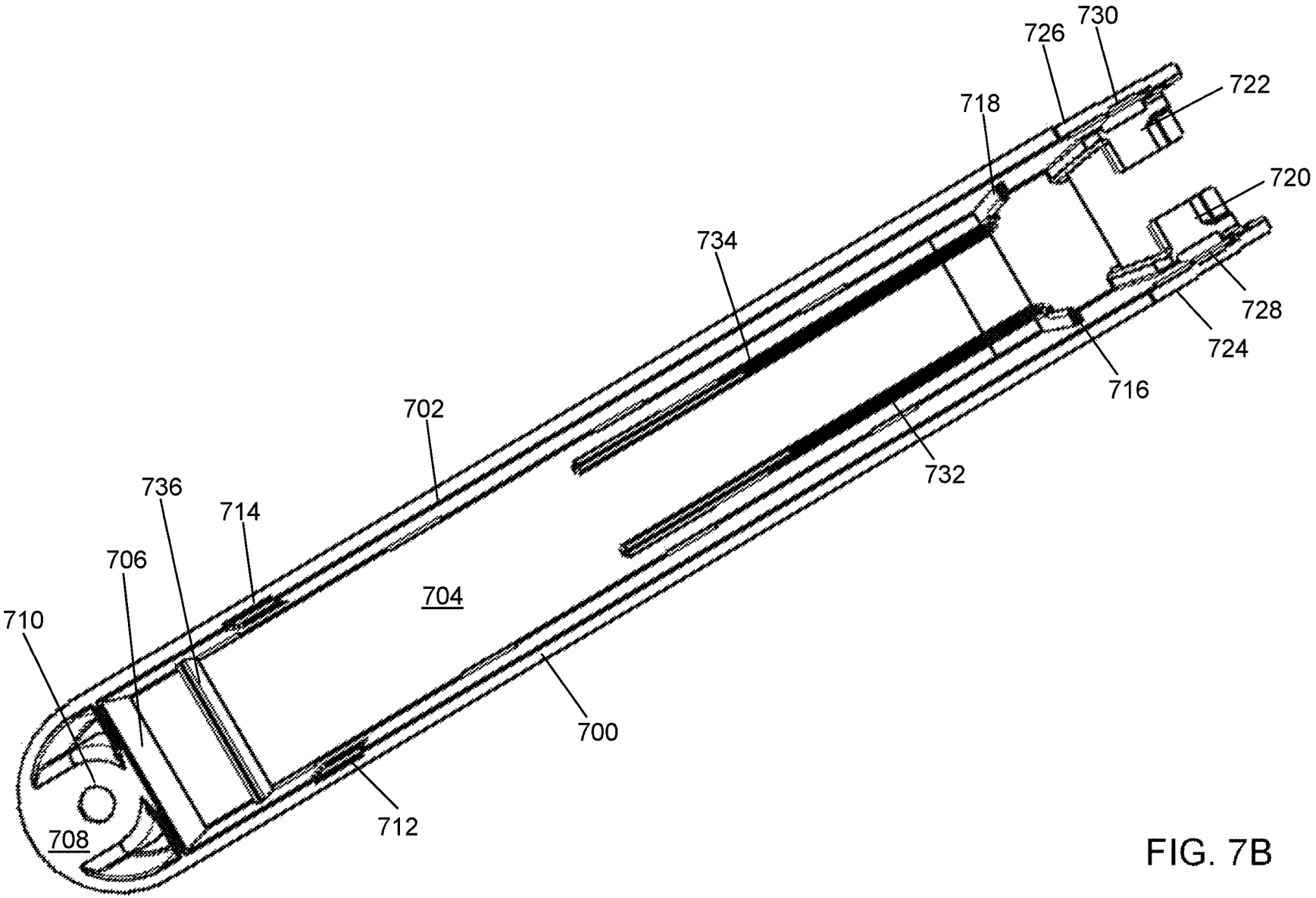
FIG. 7B depicts a top view of the bin of FIG. 7A in accordance with an illustrative embodiment.

With reference to FIG. 7A, a right side perspective view of bin 500 is shown in accordance with an illustrative embodiment. With reference to FIG. 7B, a top view of bin 500 is shown in accordance with an illustrative embodiment. Bin 500 may include a right sidewall 700, a left sidewall 702, a bottom wall 704, a front wall 706, a mounting wall 708, a first fastener aperture wall 710, a first right tab glide 712, a first left tab glide 714, a right sheath support 716, a left sheath support 718, a right connector support wall 720, a left connector support wall 722, a right protrusion 724, a left protrusion 726, a second right tab glide 728, a second left tab glide 730, a right cover support wall 732, a left cover support wall 734, and a front cover support wall 736. Though bin 500 is described as including multiple structural elements, in an illustrative embodiment, bin 500 may be formed as a single structure, for example, using a molding process. In alternative embodiments, bin 500 may be formed with one or more of the described elements welded together, for example, using a sonic welding process. Bin 500 may be formed of one or more materials including metal and/or plastic.

Right sidewall 700, left sidewall 702, bottom wall 704, and front wall 706 form an enclosed space that is open above bottom wall 704. Mounting wall 708 extends outward from front wall 706 and includes first fastener aperture wall 710 formed therethrough. First fastener 400 inserted through first fastener aperture wall 710 and into door 102 mounts bin 500 to door 102.

Right sheath support 716 and left sheath support 718 extend outward from an interior surface of right sidewall 700 and an interior surface of left sidewall 702, respectively. First right tab glide 712 is an indentation formed in the interior surface of right sidewall 700. First left tab glide 714 is an indentation formed in the interior surface of left sidewall 702. Right protrusion 724 and left protrusion 726 extend outward and angled downward from right sidewall 700 and left sidewall 702, respectively. Second right tab glide 728 is an indentation formed in an interior surface of right protrusion 724. Second left tab glide 730 is an indentation formed in an interior surface of left protrusion 726.

Right cover support wall 732 and left cover support wall 734 are mounted to extend upward from bottom wall 704. Right cover support wall 732 extends from a base of right sheath support 716 towards front wall 706. Left cover support wall 734 extends from a base of left sheath support 718 towards front wall 706. Front cover support wall 736 is mounted to extend upward from bottom wall 704 between right sidewall 700 and left sidewall 702.

Right connector support wall 720 is mounted to extend outward from an interior surface of right protrusion 724. Left connector support wall 722 is mounted to extend outward from an interior surface of left protrusion 726. Door cable connector 414 is sized and shaped to rest on right connector support wall 720 and on left connector support wall 722.

Figure 8A:
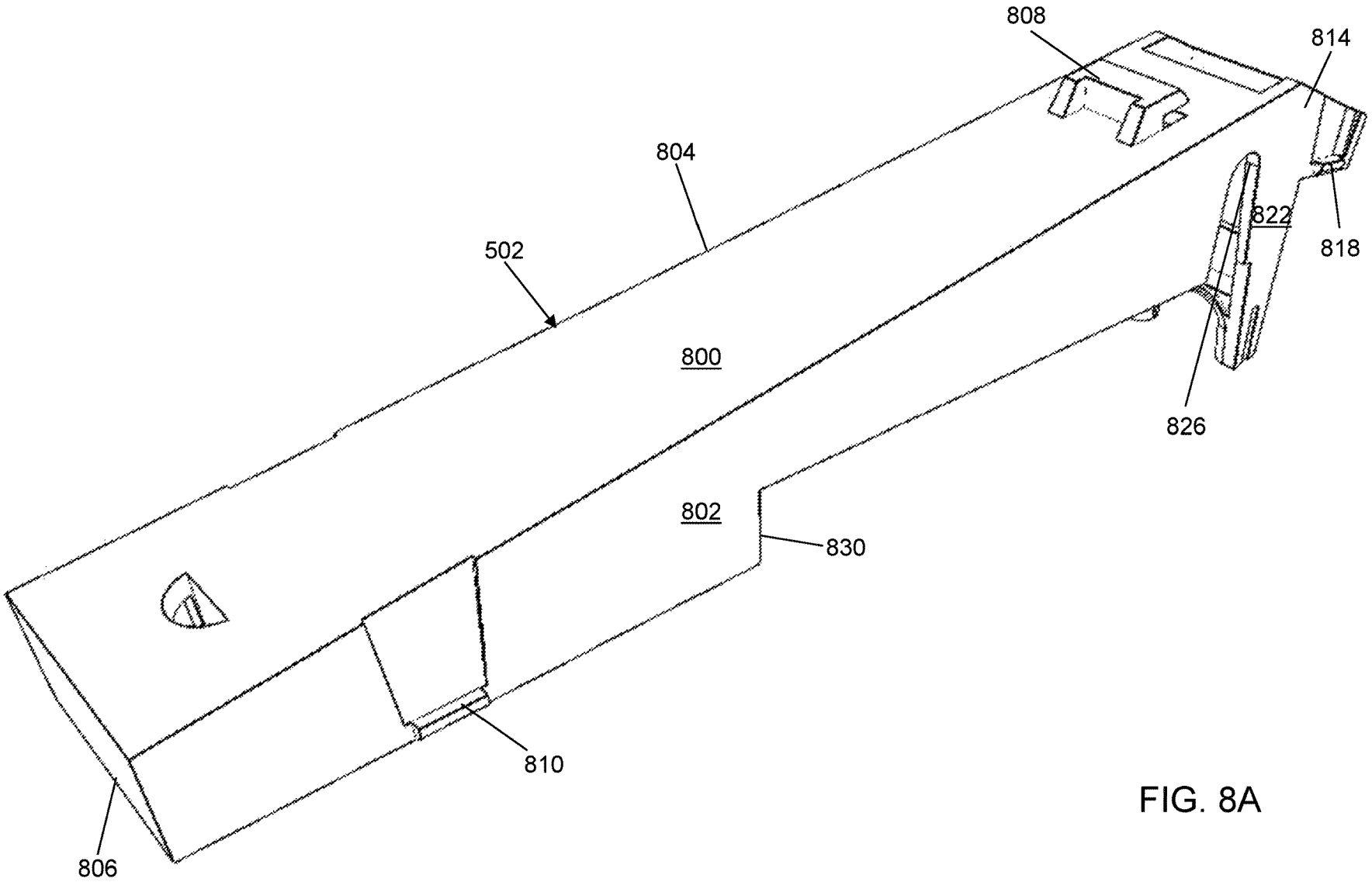
FIG. 8A depicts a right side perspective view of a cover of the recoil device body of the cable recoil device of FIG. 3 in accordance with an illustrative embodiment.
Figure 8B:
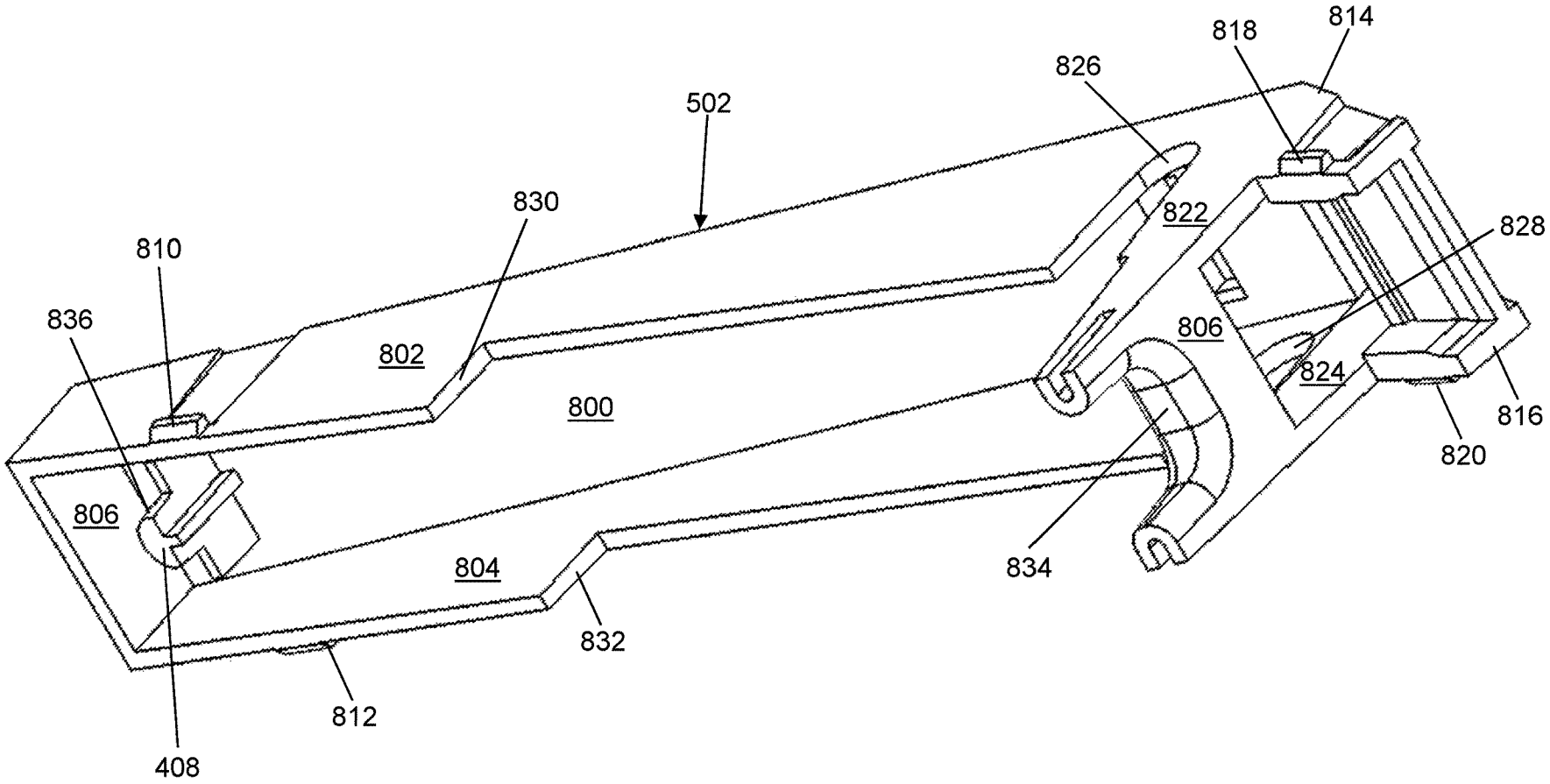
FIG. 8B depicts a bottom perspective view of the cover of FIG. 8A in accordance with an illustrative embodiment.

With reference to FIG. 8A, a right side perspective view of cover 502 is shown in accordance with an illustrative embodiment. With reference to FIG. 8B, a bottom perspective view of cover 502 is shown in accordance with an illustrative embodiment. Cover 502 may include a hook 408, a top wall 800, a cover right sidewall 802, a cover left sidewall 804, a cover front wall 806, a top mounting tab 808, a front right mounting tab 810, a front left mounting tab 812, a cover right protrusion 814, a cover left protrusion 816, a back right mounting tab 818, a back left mounting tab 820, a right support leg 822, a left support leg 824, a right sheath aperture wall 826, a left sheath aperture wall 828, a right yoke wall edge 830, a left yoke wall edge 832, and an arched wall 834. Though cover 502 is described as including multiple structural elements, in an illustrative embodiment, cover 502 may be formed as a single structure, for example, using a molding process. In alternative embodiments, cover 502 may be formed with one or more of the described elements welded together, for example, using a sonic welding process. Cover 502 may be formed of one or more materials including metal and/or plastic.

Hook 408 is mounted to extend downwards from top wall 800. Hook 408 may include a curved surface 836 that faces cover front wall 806.

In the illustrative embodiment, top wall 800, cover right sidewall 802, cover left sidewall 804, and cover front wall 806 form an enclosed space that is open below top wall 800. Top mounting tab 808 extends outward from an exterior surface of top wall 800. Top mounting tab 808 inserted into an aperture wall of door 102 mounts cover 502 to door 102.

Front right mounting tab 810 extends outward from an exterior surface of cover right sidewall 802. Front left mounting tab 812 extends outward from an exterior surface of cover left sidewall 804. Similar to right protrusion 724 and left protrusion 726, cover right protrusion 814 and cover left protrusion 816 extend outward and angled downward from cover right sidewall 802 and cover left sidewall 804, respectively. Back right mounting tab 818 extends outward from an exterior surface of cover right protrusion 814. Back left mounting tab 820 extends outward from an exterior surface of cover left protrusion 816.

Right sheath aperture wall 826 and left sheath aperture wall 828 are formed in cover right sidewall 802 and in cover left sidewall 804, respectively, as arced cutouts. Right support leg 822 and left support leg 824 extend downward from cover right sidewall 802 and in cover left sidewall 804, respectively. Arched wall 834 is formed between right support leg 822 and left support leg 824. Right yoke wall edge 830 and left yoke wall edge 832 extend downward from cover right sidewall 802 and in cover left sidewall 804, respectively.

When cover 502 is mounted to bin 500, front right mounting tab 810, front left mounting tab 812, back right mounting tab 818, and back left mounting tab 820 are aligned to slide downward along first right tab glide 712, first left tab glide 714, second right tab glide 728, and second left tab glide 730, respectively, and may snap into channels (not shown) formed in the glides 712, 714, 728, 730 to removably attach cover 502 to bin 500. When cover 502 is mounted to bin 500, cover right sidewall 802 and cover left sidewall 804 may abut and rest on right cover support wall 732, left cover support wall 734, and front cover support wall 736. When cover 502 is mounted to bin 500, cover right protrusion 814 and cover left protrusion 816 may abut and rest on right connector support wall 720 and left connector support wall 722, respectively, and provide a cover over door cable connector 414. When cover 502 is mounted to bin 500, right support leg 822 and left support leg 824 may rest on and abut bottom wall 704.

Figure 9B:
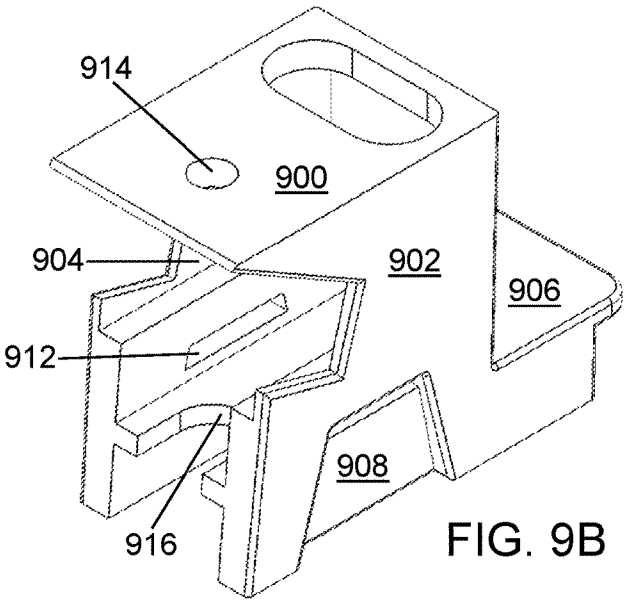
FIG. 9B depicts a front, right side perspective view of the housing cap of FIG. 9A in accordance with an illustrative embodiment.
Figure 9A:
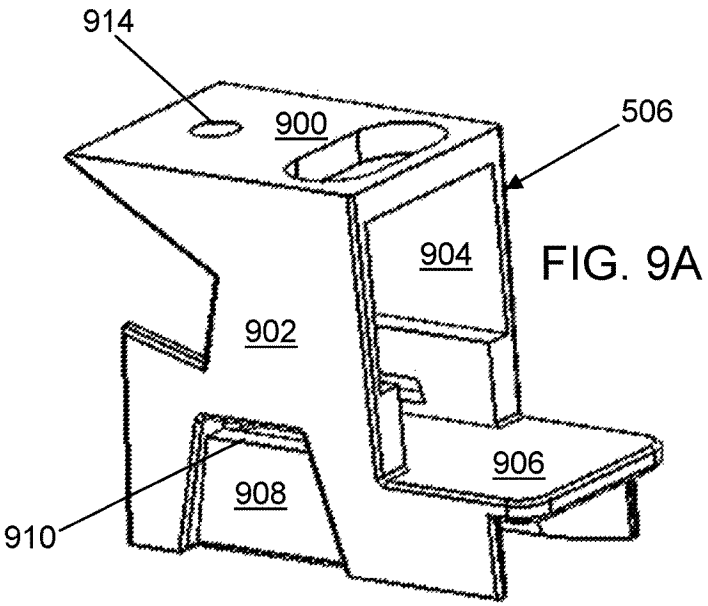
FIG. 9A depicts a back, right side perspective view of a housing cap of the recoil device body of the cable recoil device of FIG. 3 in accordance with an illustrative embodiment.

With reference to FIG. 9A, a back, right side perspective view of housing cap 506 is shown in accordance with an illustrative embodiment. With reference to FIG. 9B, a front, right side perspective view of housing cap 506 is shown in accordance with an illustrative embodiment. Housing cap 506 may include a cap top wall 900, a cap right sidewall 902, a cap left sidewall 904, a cap bottom wall 906, a third right tab glide 908, a right tab head channel 910, a third left tab glide (not shown), a right tab head channel 912, a second fastener aperture wall 914, and a cable aperture wall 916. Though housing cap 506 is described as including multiple structural elements, in an illustrative embodiment, housing cap 506 may be formed as a single structure, for example, using a molding process. In alternative embodiments, housing cap 506 may be formed with one or more of the described elements welded together, for example, using a sonic welding process. Housing cap 506 may be formed of one or more materials including metal and/or plastic.

Second fastener 402 inserted through second fastener aperture wall 914 and into door 102 mounts housing cap 506 to door 102. Cap top wall 900, cap right sidewall 902, cap left sidewall 904, and cap bottom wall 906 form an enclosed space that is open to the front and the back. Cap right sidewall 902 and cap left sidewall 904 are sized and shaped to abut bin 500 and cover 502 including right protrusion 724 and left protrusion 726. Because right protrusion 724 and left protrusion 726 of bin 500 fit within cap right sidewall 902 and cap left sidewall 904, respectively, bin 500 is also indirectly mounted to door 102 by second fastener 402.

Third right tab glide 908 is an indentation formed in an exterior surface of cap right sidewall 902. The third left tab glide is an indentation formed in an exterior surface of cap left sidewall 904. Right tab head channel 910 is formed at an end of third right tab glide 908. Left tab head channel 912 is formed at an end of the third left tab glide. Cable aperture wall 916 is formed in cap bottom wall 906 to form an arch.

Figure 10:
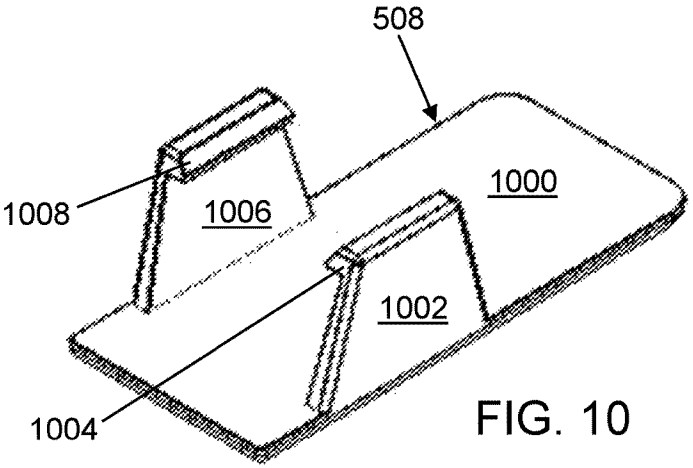
FIG. 10 depicts a right side perspective view of a cap floor piece of the cable recoil device of FIG. 3 in accordance with an illustrative embodiment.

With reference to FIG. 10, a right side perspective view of cap floor piece 508 is shown in accordance with an illustrative embodiment. Cap floor piece 508 may include a floor bottom wall 1000, a right side tab wall 1002, a right side tab head 1004, a left side tab wall 1006, and a left side tab head 1008. Right side tab wall and 1002 and left side tab wall 1006 extend upward from right and left edges of floor bottom wall 1000, respectively. Right side tab head 1004 and left side tab head 1008 extend inward from an edge of right side tab wall 1002 and an edge of left side tab wall 1006 opposite floor bottom wall 1000, respectively. When housing cap 506 is mounted to cap floor piece 508, right side tab wall 1002 and left side tab wall 1006 are aligned to slide along third right tab glide 908 and the third left tab glide, respectively, until right side tab head 1004 snaps into right tab head channel 910 and left side tab head 1008 snaps into left tab head channel 912 to removably attach housing cap 506 to cap floor piece 508.

Figure 11:
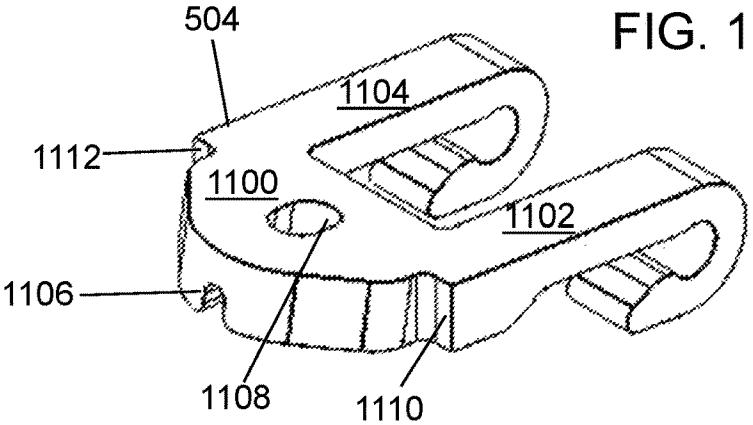
FIG. 11 depicts a right side perspective view of a pulley yoke of the cable recoil device of FIG. 3 in accordance with an illustrative embodiment.

With reference to FIG. 11, a right side perspective view of pulley yoke 504 is shown in accordance with an illustrative embodiment. Pulley yoke 504 may include a yoke body 1100, a right hooked arm 1102, a left hooked arm 1104, a spring hook channel wall 1106, a spring hook aperture wall 1108, a right yoke shelf 1110, and a left yoke shelf 1112. Right hooked arm 1102 extends away from yoke body 1100 on a right side. Left hooked arm 1104 extends away from yoke body 1100 on a left side.

Spring hook aperture wall 1108 is formed in yoke body 1100. Spring hook channel wall is formed through yoke body 1100 and connects to spring hook aperture wall 1108. When door 102 is in the closed position, right yoke shelf 1110 and left yoke shelf 1112 abut right yoke wall edge 830 and left yoke wall edge 832, respectively, to hold pulley yoke 504 in position within bin 500.

Figure 12:
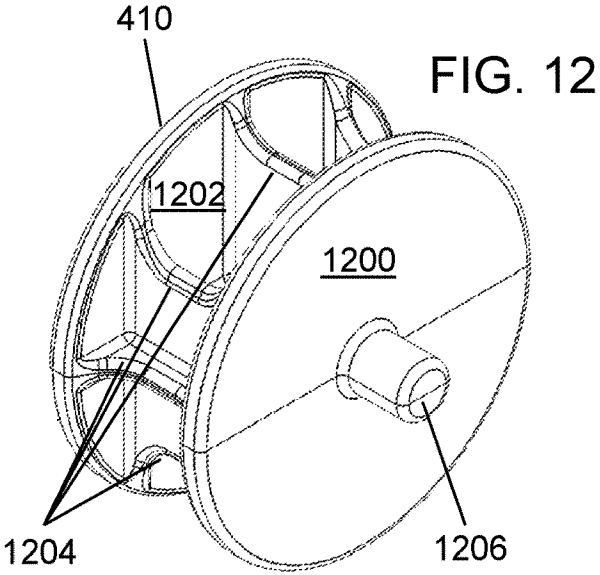
FIG. 12 depicts a right side perspective view of a pulley of the cable recoil device of FIG. 3 in accordance with an illustrative embodiment.

With reference to FIG. 12, a right side perspective view of pulley 410 is shown in accordance with an illustrative embodiment. Pulley 410 may include a right circular wall 1200, a left circular wall 1202, a plurality of ribs 1204, a right hub 1206, and a left hub (not shown). Pulley 410 has a wheel shaped body. The plurality of ribs 1204 are connected between right circular wall 1200 and left circular wall 1202. Right hub 1206 extends outward from right circular wall 1200. The left hub extends outward from left circular wall 1202. Right hooked arm 1102 is mounted to right hub 1206, and left hooked arm 1104 is mounted to the left hub in a manner that supports translation of pulley 410, but not rotation of pulley 410.

Figure 13:
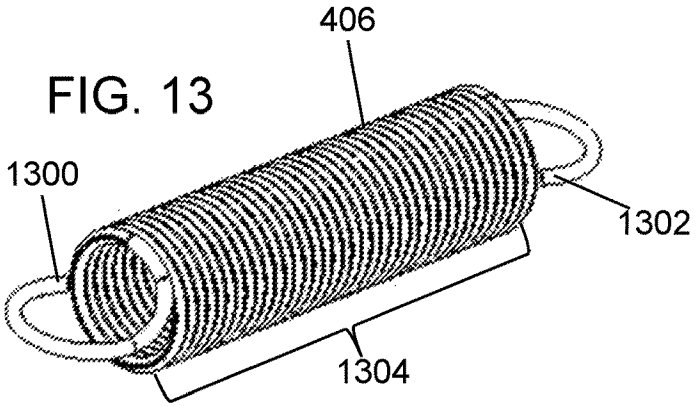
FIG. 13 depicts a right side perspective view of a spring of the cable recoil device of FIG. 3 in accordance with an illustrative embodiment.

With reference to FIG. 13, a right side perspective view of spring 406 is shown in accordance with an illustrative embodiment. Spring 406 may include a first spring hook 1300, a second spring hook 1302, and a plurality of coils 1304 wound between first spring hook 1300 and second spring hook 1302. Hook 408 may include a curved surface 836 sized and shaped to hold first spring hook 1300 and to provide a first tension point for spring 406. Second spring hook 1102 mounts to yoke body 1200 within spring hook channel wall 1106 and spring hook aperture wall 1108 to provide a second tension point for spring 406. Hook 408 may be mounted to other walls of bin 500 or cover 502. In alternative embodiments, other forms of attachment of spring 406 to bin 500 or cover 502 and to yoke body 1100 may be used.

In an illustrative embodiment, spring 406 is a helical or coil spring that provides tension between cable recoil device 208 and pulley 410 while supporting movement of pulley 410 and thereby cable 214 as door 102 opens or closes. Translational movement of pulley 410 under control of spring 406 takes up a slack of cable 214 within bin 500 needed when door 102 is opened. Cable 214 is wound at least partially around a circumference of the plurality of ribs 1204. At least some of the plurality of ribs 1204 comprise arc-shaped edges within which cable 214 is held on pulley 410 for translation of cable 214 with pulley 410 when door 102 is opened and closed. Spring 406 may be selected to provide the tension to move pulley 410 toward cover front wall 806 to allow the slack in cable 214 to be pulled outside recoil device body 404 when door 102 is opened and to take up the slack so that cable 214 is pulled back within recoil device body 404 when door 102 is closed.

Figure 14:
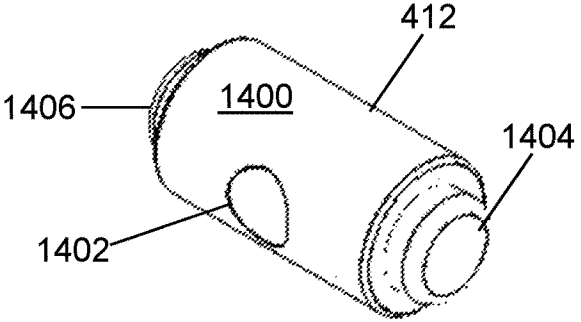
FIG. 14 depicts a right side perspective view of a cable sheath of the cable recoil device of FIG. 3 in accordance with an illustrative embodiment.

With reference to FIG. 14, a right side perspective view of cable sheath 412 is shown in accordance with an illustrative embodiment. Cable sheath 412 may include a sheath body 1400, a cable aperture wall 1402 formed through a center of sheath body 1400, a right sheath head 1404, and a left sheath head 1406. Right sheath head 1404 extends outward from a right edge of sheath body 1400. Left sheath head 1406 extends outward from a left edge of sheath body 1400. Right sheath head 1404 fits within right sheath aperture wall 826, and left sheath head 1406 fits within left sheath aperture wall 828 to hold cable sheath 412 in position relative to recoil device body 404. Cable 214 is inserted through cable aperture wall 1402. Cable sheath 412 limits a movement of cable 214 relative to cable sheath 412 to reduce or eliminate a stress on door cable connector 414 as cable 214 is moved when door 102 is opened and closed.

Figure 15B:
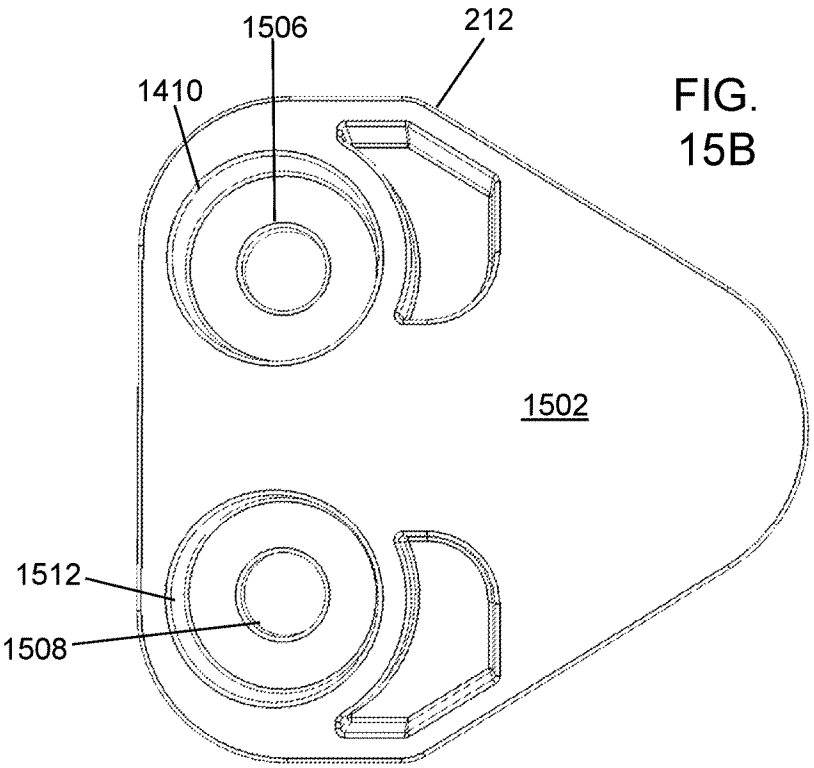
FIG. 15B depicts a bottom view of the cable body connector of FIG. 15A in accordance with an illustrative embodiment.
Figure 15A:
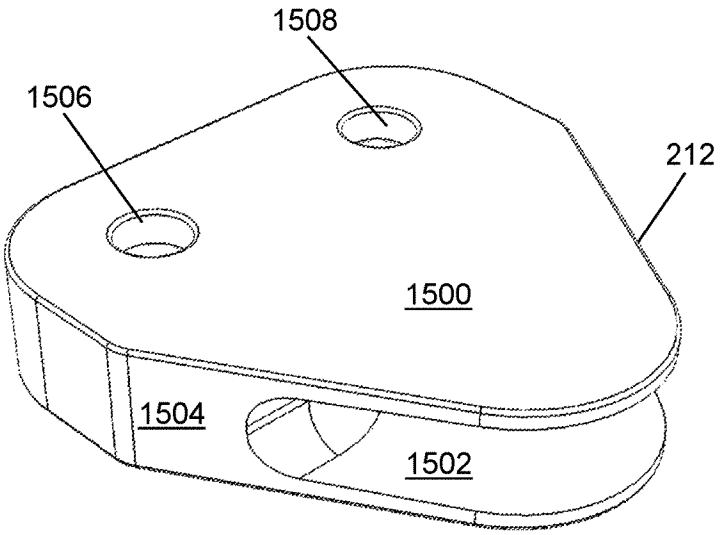
FIG. 15A depicts a left perspective view of a cable body connector of the cable assembly of FIG. 6 in accordance with an illustrative embodiment.
Figure 15C:
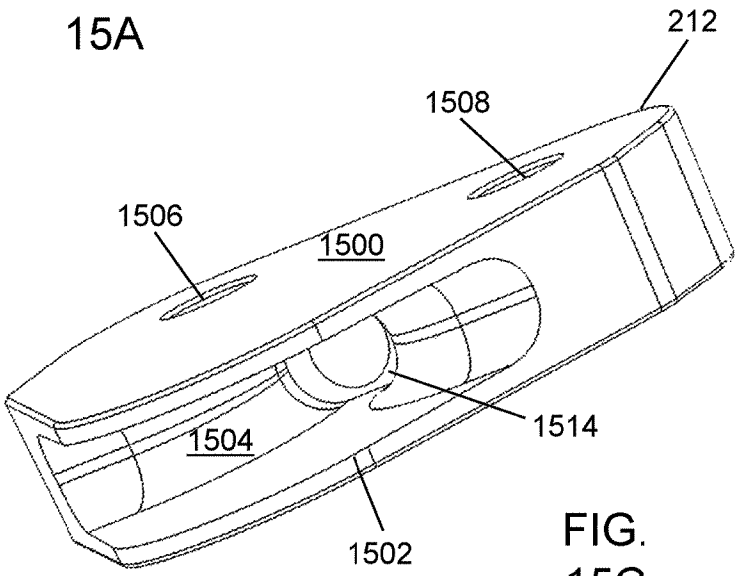
FIG. 15C depicts a right perspective view of the cable body connector of FIG. 15A in accordance with an illustrative embodiment.

With reference to FIG. 15A, a left perspective view is shown of cable body connector 212 in accordance with an illustrative embodiment. With reference to FIG. 15B, a bottom view is shown of cable body connector 212 in accordance with an illustrative embodiment. With reference to FIG. 15C, a right perspective view is shown of cable body connector 212 in accordance with an illustrative embodiment. Cable body connector 212 may include a connector top wall 1500, a connector bottom wall 1502, a connector sidewall 1504, a first fastener shaft aperture wall 1506, a second fastener shaft aperture wall 1508, a first fastener head aperture wall 1510, a second fastener head aperture wall 1512, and a connector cable aperture wall 1514. First fastener shaft aperture wall 1506 and second fastener shaft aperture wall 1508 are sized and shaped to accommodate a shaft of third fastener 604 and fourth fastener 606, respectively, but not a head of third fastener 604 and fourth fastener 606. First fastener head aperture wall 1506 and second fastener head aperture wall 1508 are sized and shaped to accommodate a head of third fastener 604 and fourth fastener 606, respectively, so that cable body connector 212 can be flush mounted to body 200.

Connector sidewall 1504 extends partially between connector top wall 1500 and connector bottom wall 1502. Cable 214 is inserted through connector cable aperture wall 1514. Connector top wall 1500 and connector bottom wall 1502 extend beyond connector sidewall 1504 to form a cavity within which cable 214 can be moved for right or left side mounting to device 100 and to allow cable 214 to pivot when door 102 is opened relative to body 200. Connector sidewall 1504 is curved in the cavity so that cable 214 can be moved to the right or the left while reducing a pressure on cable 214.

In the illustrative embodiment, body connector 212 is shaped to minimize a footprint on body section 308. Third fastener 604 is inserted in first fastener shaft aperture wall 1506 and first fastener head aperture wall 1510, and fourth fastener 606 is inserted in first fastener shaft aperture wall 1506 and first fastener head aperture wall 1510 to mount cable body connector 212 to body section 308. When mounted, connector top wall 1500 abuts body section 308 or another mounting surface of body 200 of device 100.

Figure 16:
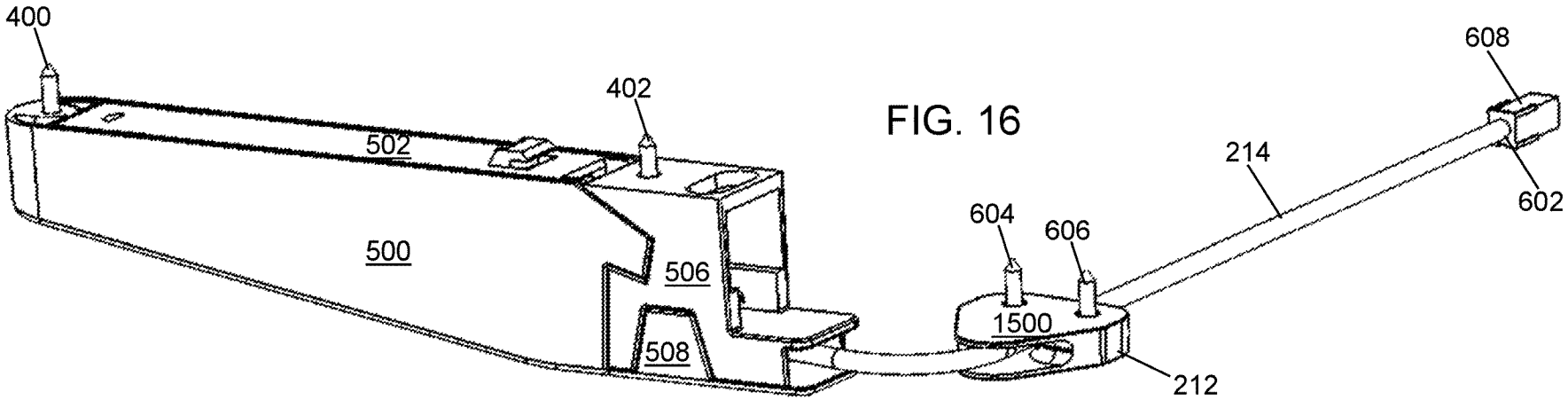
FIG. 16 depicts a right side perspective view of the cable assembly of FIG. 6 in accordance with an illustrative embodiment.
Figure 17:
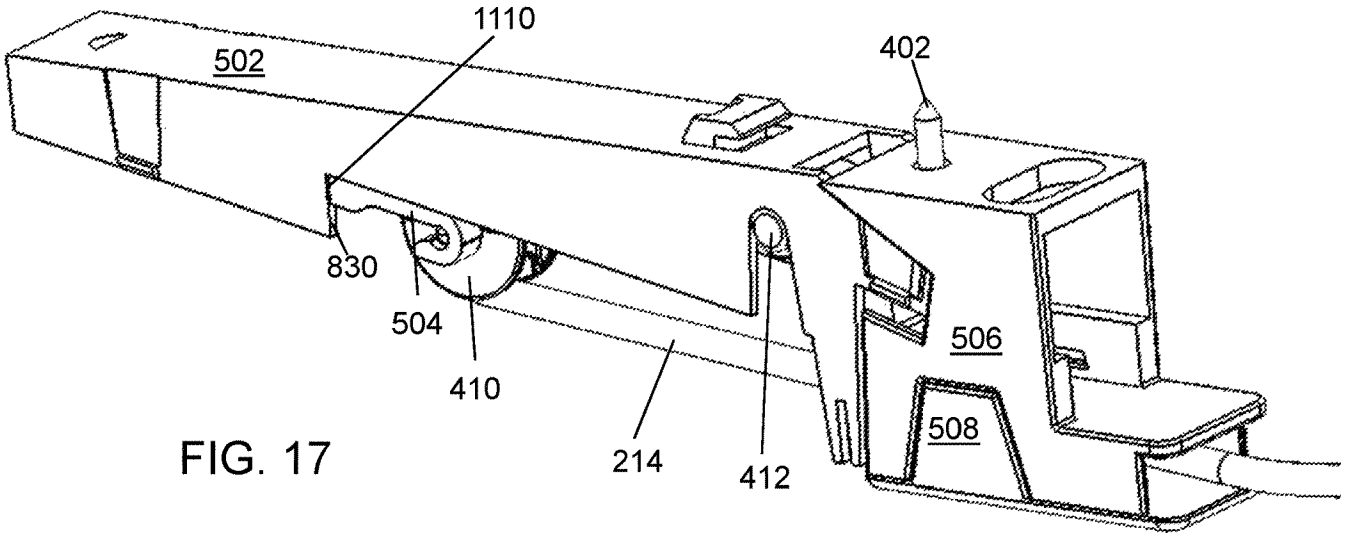
FIG. 17 depicts a right side perspective view of the cable recoil device of FIG. 3 without the bin in accordance with an illustrative embodiment.
Figure 18:
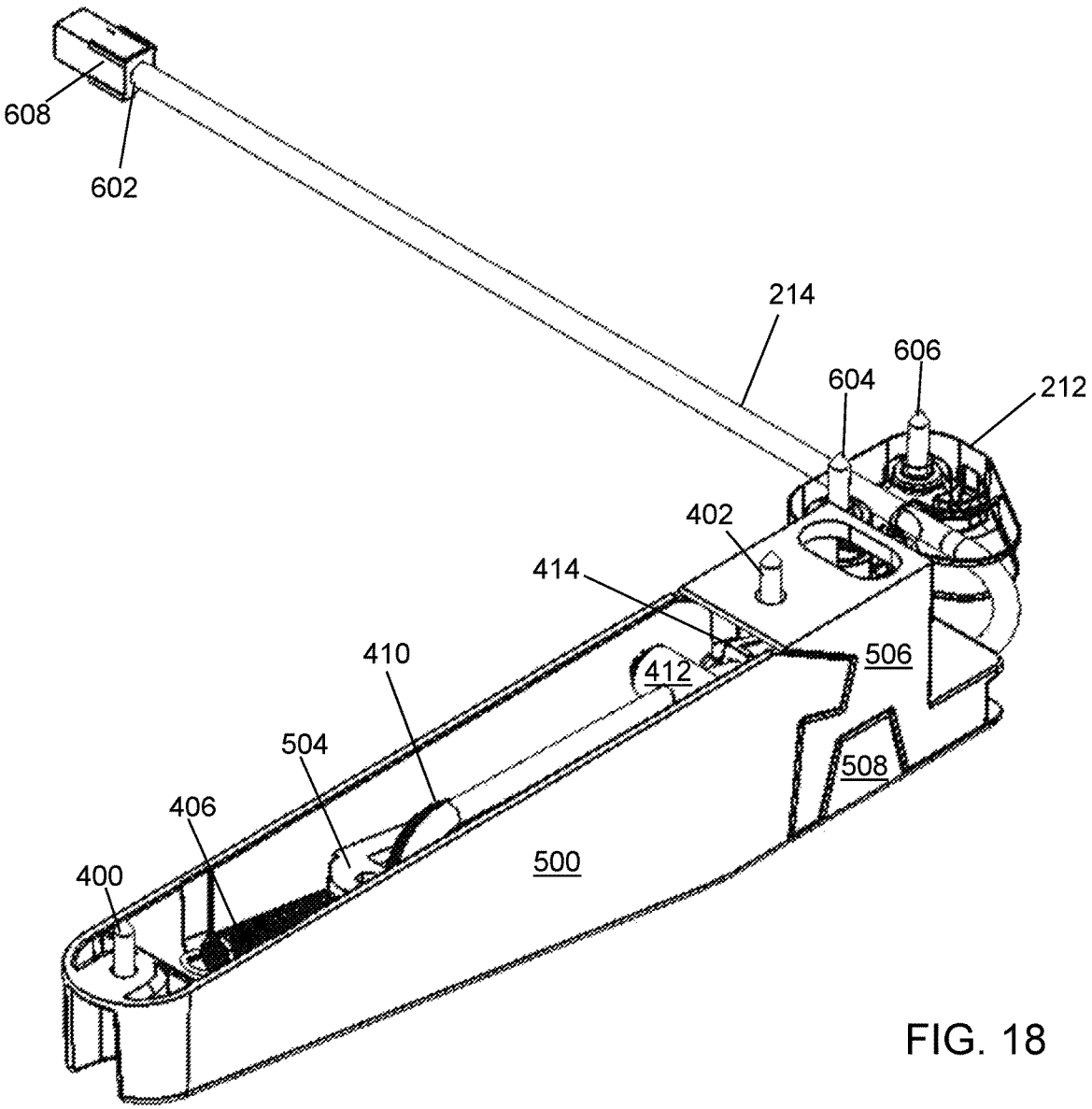
FIG. 18 depicts a right side perspective view of the cable recoil device of FIG. 3 without the cover in accordance with an illustrative embodiment.
Figure 19:
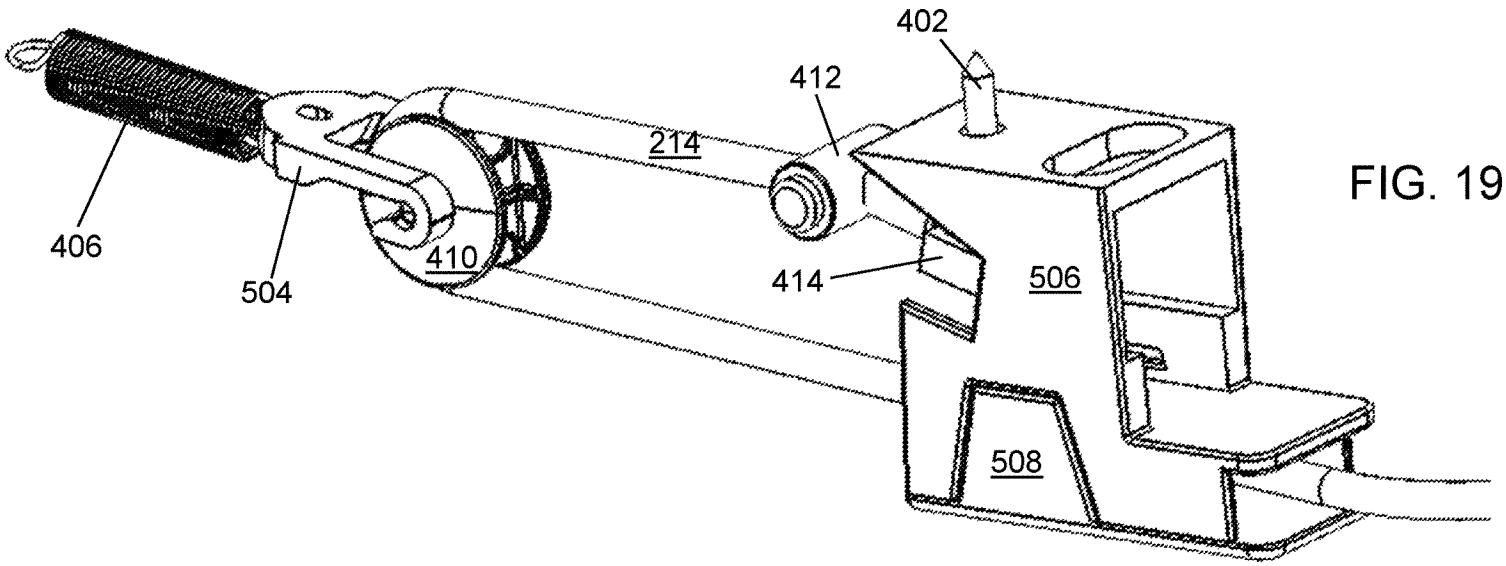
FIG. 19 depicts a right side perspective view of the cable recoil device of FIG. 3 without the bin or the cover in accordance with an illustrative embodiment.
Figure 20:
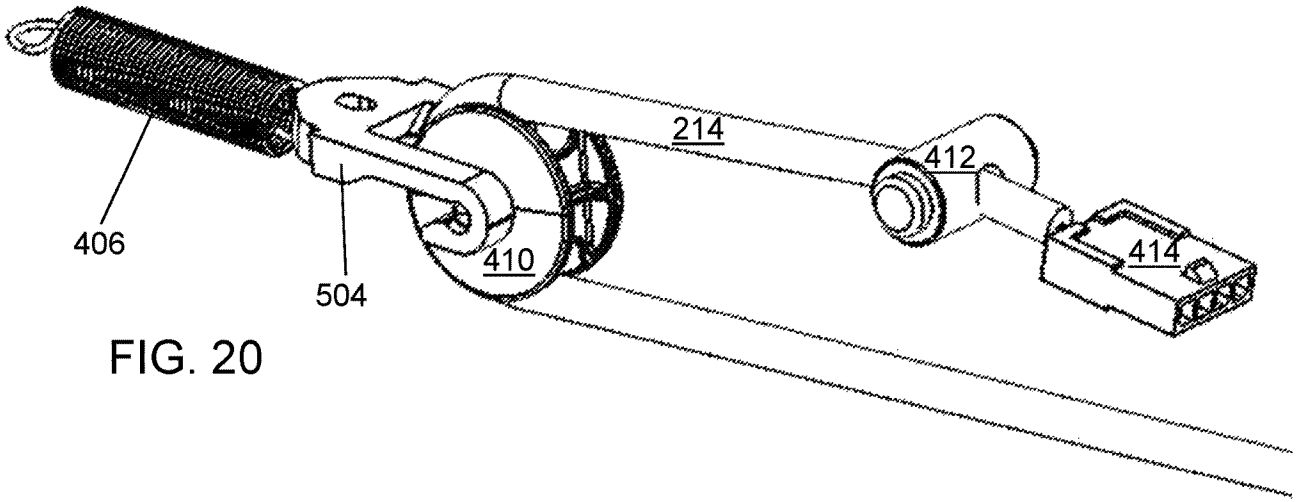
FIG. 20 depicts a right side perspective view of the cable recoil device of FIG. 3 without the recoil device body in accordance with an illustrative embodiment.
Figure 21:
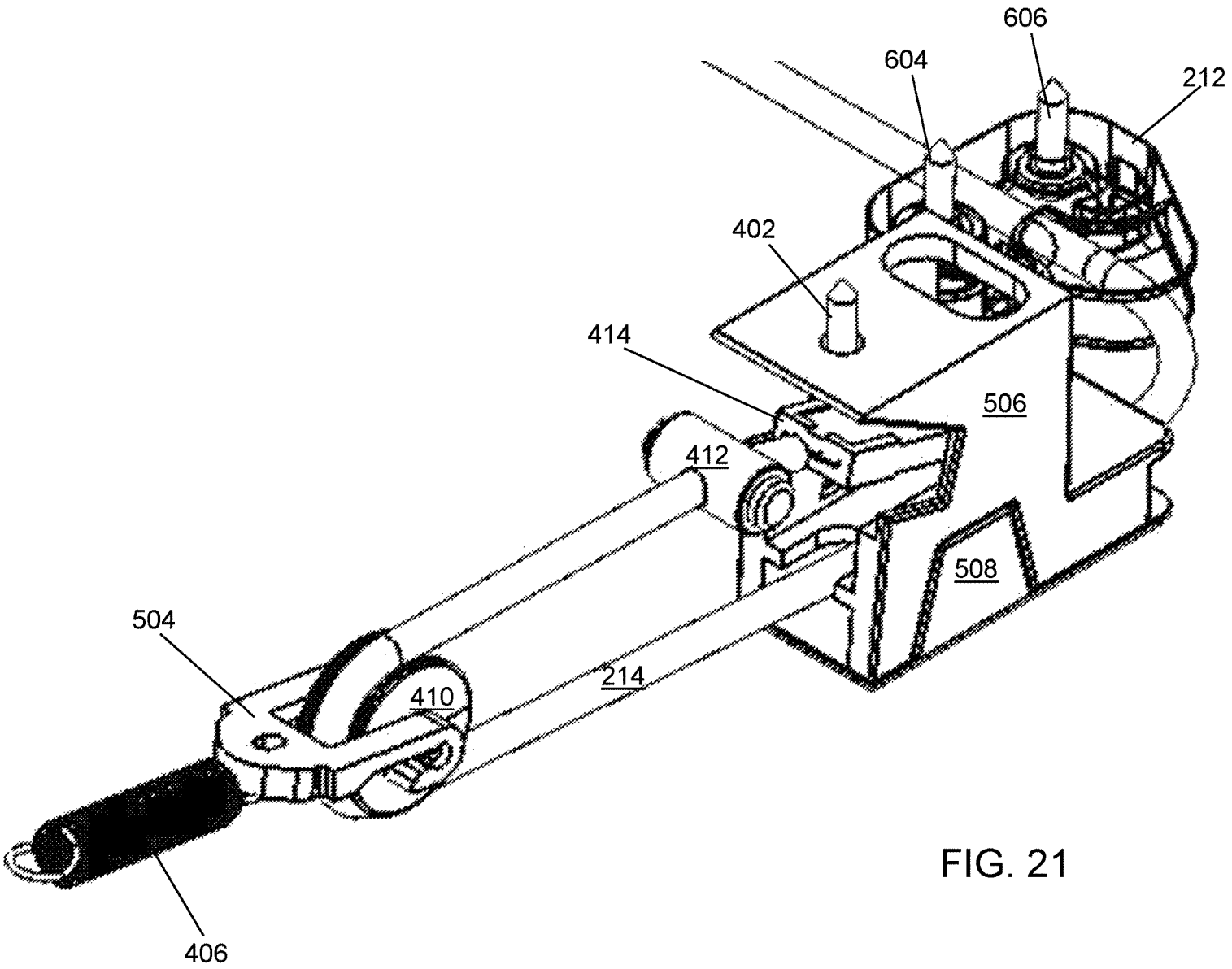
FIG. 21 depicts a front perspective view of the cable recoil device of FIG. 3 without the bin or the cover in accordance with an illustrative embodiment.

With reference to FIG. 16, a right side perspective view is shown of cable assembly 600 in accordance with an illustrative embodiment. With reference to FIG. 17, a right side perspective view is shown of cable recoil device 208 without bin 500 and with spring 406 in the door closed position in accordance with an illustrative embodiment. With reference to FIG. 18, a right side perspective is shown of cable recoil device 208 without cover 502 and with spring 406 in the door closed position in accordance with an illustrative embodiment. With reference to FIG. 19, a right side perspective view is shown of cable recoil device 208 without bin 500 or the cover in accordance with an illustrative embodiment. With reference to FIG. 20, a right side perspective view is shown of cable recoil device 208 without recoil device body 404 and with spring 406 in the door closed position in accordance with an illustrative embodiment. With reference to FIG. 21, a front perspective view is shown of cable recoil device 208 without bin 500 or cover 502 and with spring 406 in the door closed position in accordance with an illustrative embodiment.

Figure 22A:
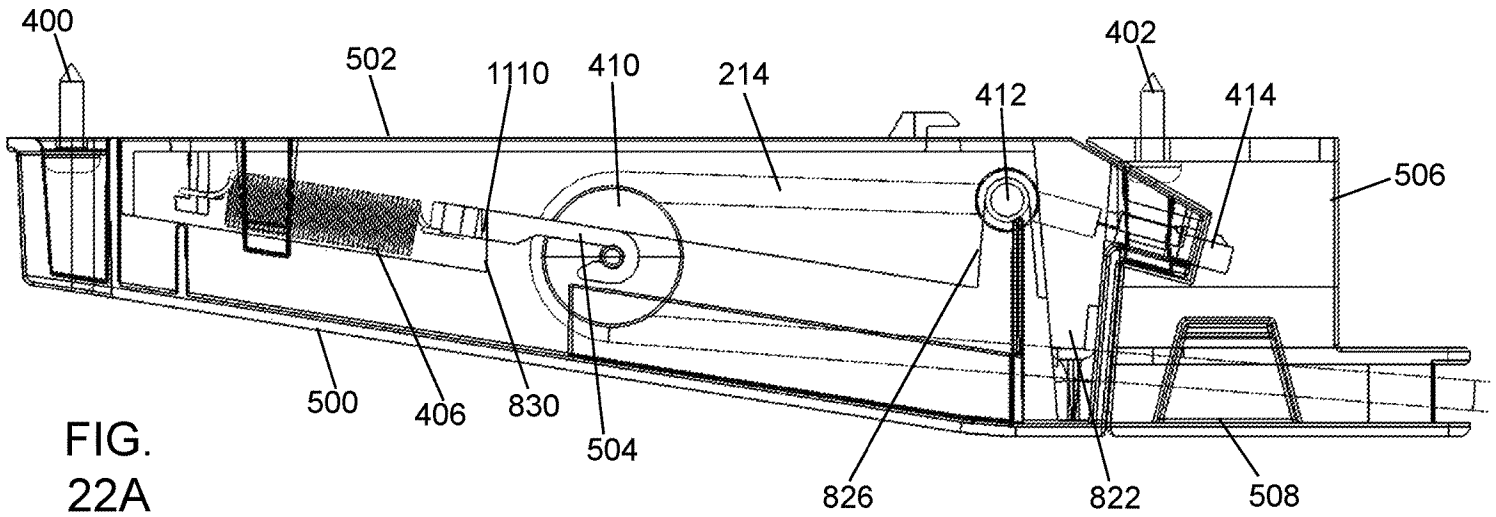
FIG. 22A depicts a right side view of the cable recoil device of FIG. 3 with the recoil device body transparent in accordance with an illustrative embodiment.
Figure 22B:
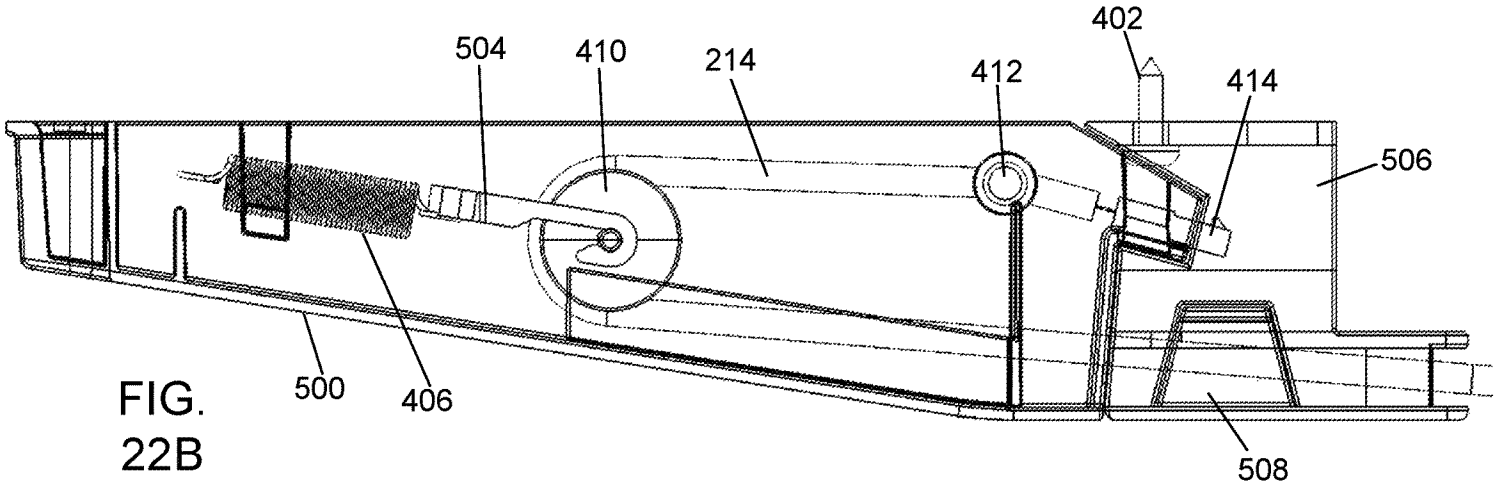
FIG. 22B depicts a right side view of the cable recoil device of FIG. 3 with the recoil device body transparent and the cover removed in accordance with an illustrative embodiment.
Figure 22C:
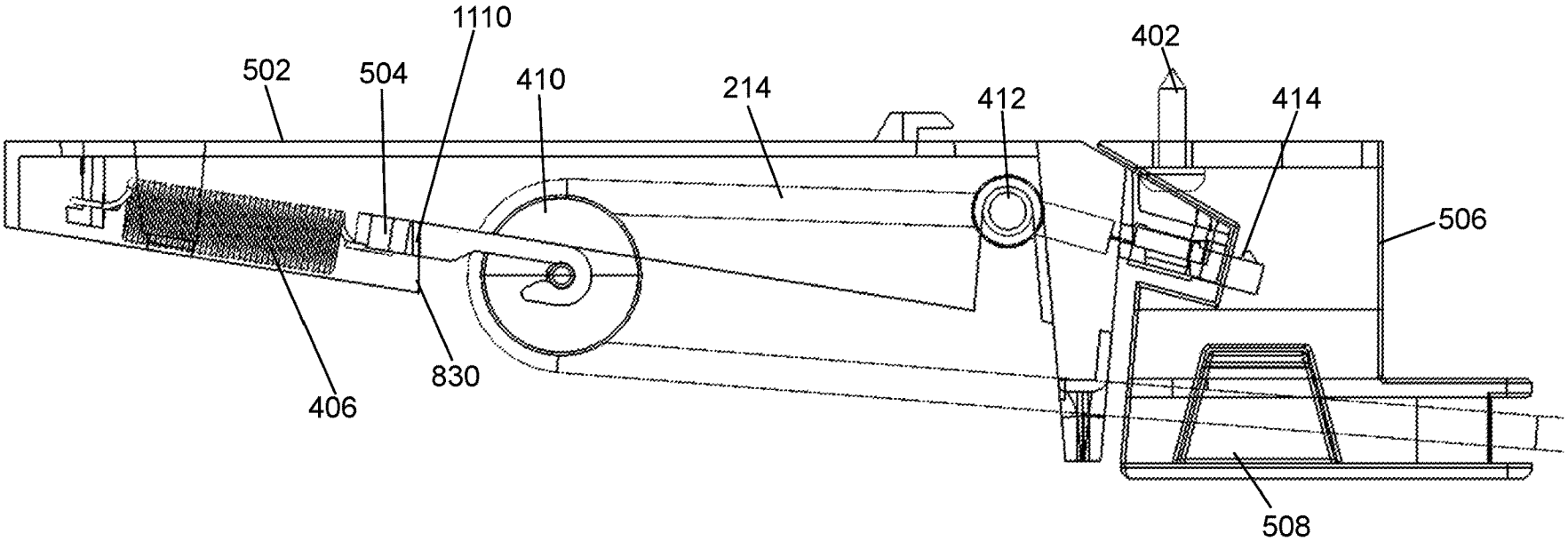
FIG. 22C depicts a right side view of the cable recoil device of FIG. 3 with the recoil device body transparent and the bin removed in accordance with an illustrative embodiment.

With reference to FIG. 22A, a right side view is shown of cable recoil device 208 with recoil device body 404 transparent and with spring 406 in the door closed position in accordance with an illustrative embodiment. With reference to FIG. 22B, a right side view is shown of cable recoil device 208 with recoil device body 404 transparent, with cover 502 removed and with spring 406 in the door closed position in accordance with an illustrative embodiment. With reference to FIG. 22C, a right side view is shown of cable recoil device 208 with recoil device body 404 transparent, with bin 500 removed, and with spring 406 in the door closed position in accordance with an illustrative embodiment.

To assemble cable recoil device 208, cable 214 may be inserted through connector cable aperture wall 1514. First connector 608 may be connected to first end 602 of cable 214. Door cable connector 414 may be mounted to body 200 using third fastener 604 and/or fourth fastener 606.

Spring 406 may be connected between hook 408 of recoil device body 404 and pulley yoke 504. Cable 214 may be inserted through cable aperture wall 1402. Cable 214 may be wound partially around the plurality of ribs 1204. Right hooked arm 1102 may be mounted to right hub 1206, and left hooked arm 1104 may be mounted to the left hub. Door cable connector 414 may be connected to second end 416 of cable 214. Door cable connector 414 may be positioned below cover right protrusion 814 and cover left protrusion 816.

Cable 214 may be positioned to extend from pulley 410 below arched wall 834, between cap right sidewall 902 and cap left sidewall 90, below cap bottom wall 906, and above floor bottom wall 1000. Cap floor piece 508 may be snap fit to housing cap 506.

Right sheath head 1404 and left sheath head 1406 of cable sheath 412 may be mounted within right sheath aperture wall 826 and left sheath aperture wall 828, respectively. Right yoke shelf 1110 and left yoke shelf 1112 of pulley yoke 504 may be positioned to abut right yoke wall edge 830 and left yoke wall edge 832 to position the internal components of cable recoil device 208. Door cable connector 414 may be mounted to right connector support wall 720 and to left connector support wall 722 to fix door cable connector 414 in position within recoil device body 404. Bin 500 may be snap fit onto cover 502. Housing cap 506 may be mounted to bin 500 by positioning cap right sidewall 902 and cap left sidewall 904 to abut right protrusion 724 and left protrusion 726, respectively, of bin 500.

Top mounting tab 808 may be mounted to door 102. Bin 500 may be mounted to door 102 using first fastener 400. Housing cap 506 may be mounted to door 102 using second fastener 402.

Door cable connector 414 may include various connectors based on connectivity with the second component of door 102. First connector 608 may include various connectors based on connectivity with the first component of body 200.

Cable 214 may have various lengths and diameters based on a connectivity distance between and within cable body connector 212 and cable recoil device 208 and a distance of movement between door 102 and body 200. When door 102 is opened, cable 214 is pulled from cable recoil device 208 increasing a tension on spring 406 as shown referring to FIGS. 3B and 5B. When door 102 is closed, cable 214 is pulled back into cable recoil device 208 under control of spring 406 as shown referring to FIG. 5A. As a result, the additional length in cable 214 required to accommodate opening of door 102 does not interfere with opening and closing of door 102. Door 102 further does not close on cable 214, door cable connector 414, or first connector 608 or inadvertently apply additional pressure or tension on cable 214, door cable connector 414, or first connector 608.

Recoil device body 404 may have various shapes and sizes, be mounted to various surfaces of the walls of door 102, and include any number of separate housing elements to simplify assembly, reduce a cost of components, reduce a cost of manufacturing, reduce a cost of installation, improve an appearance of cable recoil device 208, etc.

The components of cable assembly 600 may be formed of one or more materials, such as metal, glass, and/or plastic having a sufficient strength and rigidity to provide the illustrated and/or described function. For example, cable recoil device 208 may be formed of one or more plastic materials having a sufficient strength and rigidity to support movement of cable 214 when door 102 is opened and closed without breaking. Another consideration for the choice of material may be an aesthetic appearance to the user of cable recoil device 208. Bin 500 of cable recoil device 208 may form a variety of shapes including a polygon, a circle, an ellipse, etc. of various sizes to fit in the desired location on door 102.

Housing can be different and mounted to any wall and include any number of separate housing elements to simplify parts costs, manufacturing, installation, etc. basically removable cover so can mount internal components and control direction of cable coil and recoil. Can be glued or otherwise fixed together once assembled What is needed is a recoil device that manages cable movement consistently and reliably and is held in place with a single screw. Other types of recoil mechanisms typically use torsional springs that don't lend themselves to this type of application or can fit in this long narrow space Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled relative to a front on which a door is mounted.

As used in this disclosure, the term "mount" includes join, unite, connect, couple, associate, insert, hang, hold, affix, attach, fasten, bind, paste, secure, bolt, screw, rivet, solder, weld, glue, adhere, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

The invention claimed is:

1. A cable recoil device comprising:

a cable recoil device body;

a pulley positioned within the cable recoil device body, wherein the pulley has a wheel shaped body, wherein the pulley comprises a left hub that extends outward from the wheel shaped body of the pulley; and a right hub that extends outward from the wheel shaped body of the pulley, wherein the wheel shaped body of the pulley comprises a left circular wall;

a right circular wall; and a plurality of ribs connected between the left circular wall and the right circular wall;

a pulley yoke mounted to the pulley;

a spring positioned within the cable recoil device body having a first end and a second end, wherein the first end of the spring is connected to the cable recoil device body and the second end of the spring is connected to the pulley yoke; and a cable having a first end and a second end, wherein the cable is wound at least partially around a circumference of the wheel shaped body of the pulley on the plurality of ribs, wherein, when the cable recoil device is mounted for use in a device, the first end of the cable is configured to be connected to a body of the device and the second end of the cable is configured to be connected to a door of the device that moves relative to the body of the device, wherein the spring is configured to provide a tension on the pulley such that the spring lengthens when the door of the device is opened and contracts when the door of the device is closed.

2. The cable recoil device of claim 1, wherein at least some of the plurality of ribs comprise arc-shaped edges within which the cable is held on the pulley for translation of the cable with the pulley when the door of the device is opened.

3. The cable recoil device of claim 1, wherein the left hub extends outward from the left circular wall and the right hub extends outward from the right circular wall.

4. The cable recoil device of claim 1, wherein the pulley yoke comprises:

a yoke body;

a right hooked arm that extends away from the yoke body on a right side; and a left hooked arm that extends away from the yoke body on a left side, wherein the right hooked arm is mounted to the right hub and the left hooked arm is mounted to the left hub.

5. The cable recoil device of claim 4, wherein the pulley yoke further comprises a spring hook aperture wall formed in the yoke body and within which the second end of the spring is mounted.

6. The cable recoil device of claim 5, wherein the pulley yoke further comprises a spring hook channel wall formed in the yoke body and connected to the spring hook aperture wall, wherein the second end of the spring is further mounted within the spring hook channel wall.

7. The cable recoil device of claim 4, wherein the pulley yoke further comprises:

a right yoke shelf formed on the yoke body; and a left yoke shelf on the yoke body, wherein, when the door of the device is closed, the right yoke shelf and the left yoke shelf abut a right yoke wall edge and a left yoke wall edge formed on a right sidewall and a left sidewall, respectively, of the cable recoil device body.

8. The cable recoil device of claim 1, wherein the spring is a coil spring.

9. The cable recoil device of claim 1, further comprising:

a cable sheath mounted on a side of the pulley opposite the pulley yoke, wherein the cable sheath comprises a sheath body;

a cable aperture wall formed through the sheath body wherein the cable is inserted through the cable aperture wall;

a right sheath head that extends outward from a right side of the sheath body, wherein the right sheath head mounts to a right sidewall of the cable recoil device body; and a left sheath head that extends outward from a left side of the sheath body, wherein the left sheath head mounts to a left sidewall of the cable recoil device body.

10. A cable assembly comprising:

a cable recoil device comprising a cable recoil device body;

a pulley positioned within the cable recoil device body, wherein the pulley has a wheel shaped body, wherein the pulley comprises a left hub that extends outward from the wheel shaped body of the pulley; and a right hub that extends outward from the wheel shaped body of the pulley, wherein the wheel shaped body of the pulley comprises a left circular wall:

a right circular wall; and a plurality of ribs connected between the left circular wall and the right circular wall:

a pulley yoke mounted to the pulley;

a spring positioned within the cable recoil device body having a first end and a second end, wherein the first end of the spring is connected to the cable recoil device body and the second end of the spring is connected to the pulley yoke; and a cable having a first end and a second end, wherein the cable is wound at least partially around a circumference of the wheel shaped body of the pulley on the plurality of ribs, wherein, when the cable recoil device is mounted for use in a device, the first end of the cable is configured to be connected to a body of the device and the second end of the cable is configured to be connected to a door of the device that moves relative to the body of the device, wherein the spring is configured to provide a tension on the pulley such that the spring lengthens when the door of the device is opened and contracts when the door of the device is closed;

a cable body connector comprising a connector cable aperture wall, wherein the cable is inserted through the connector cable aperture wall;

a first connecter mounted to the first end of the cable that extends from a first side of the cable body connector; and a second connecter mounted to the second end of the cable that extends from a second side of the cable body connector opposite the first side, wherein the first connecter is mounted to the body of the device so that the first connector does not move relative to the body of the device when the door of the device is opened, wherein the second connecter is mounted to the cable recoil device body so that the second connector does not move relative to the cable recoil device body when the door of the device is opened.

11. The cable assembly of claim 10, wherein the body comprises:

a bin; and a cover mounted to the bin to cover a top of the bin, wherein the pulley, the pulley yoke, and the spring are housed within the bin, wherein the first connecter is exterior of the bin and the cover.

12. The cable assembly of claim 10, wherein the pulley yoke comprises:

a yoke body;

a right hooked arm that extends away from the yoke body on a right side; and a left hooked arm that extends away from the yoke body on a left side, wherein the right hooked arm is mounted to the right hub and the left hooked arm is mounted to the left hub.

13. A device comprising:

a body;

a door mounted to the body to move relative to the body;

a cable recoil device mounted to the door, the cable recoil device comprising a cable recoil device body;

a pulley positioned within the cable recoil device body, wherein the pulley has a wheel shaped body;

a pulley yoke mounted to the pulley;

a spring positioned within the cable recoil device body having a first end and a second end, wherein the first end of the spring is connected to the cable recoil device body and the second end of the spring is connected to the pulley yoke; and a cable having a first end and a second end, wherein the cable is wound at least partially around a circumference of the wheel shaped body of the pulley, wherein the spring is configured to provide a tension on the pulley such that the spring lengthens when the door of the device is opened and contracts when the door of the device is closed;

a cable body connector mounted to the body, the cable body connector comprising a connector cable aperture wall, wherein the cable is inserted through the connector cable aperture wall;

a first connecter mounted to the first end of the cable that extends from a first side of the cable body connector, wherein the first connecter is mounted to the body so that the first connecter does not move relative to the body when the door of the device is opened; and a second connecter mounted to the second end of the cable that extends from a second side of the cable body connector opposite the first side, wherein the second connecter is mounted to the cable recoil device body so that the second connector does not move relative to the cable recoil device body when the door of the device is opened.

14. The device of claim 13, further comprising a hinge connected between the body and the door to support opening of the door relative to the body, the hinge comprising:

a door section mounted to the door;

a body section mounted to the body; and an articulating section mounted to the body section and the door section, wherein the cable body connector is mounted adjacent the body section.

15. The device of claim 14, wherein the cable body connector is mounted to and below the body section.

16. The device of claim 13, wherein the cable is configured to provide at least one of an electrical current, an electrical signal, and a fluid between the body and the door.

17. The device of claim 13, wherein the wheel shaped body of the pulley comprises:

a left circular wall;

a right circular wall; and a plurality of ribs connected between the left circular wall and the right circular wall, wherein the cable is wound on the plurality of ribs, wherein the pulley further comprises a left hub that extends outward from the left circular wall; and a right hub that extends outward from the right circular wall.

18. The device of claim 17, wherein the pulley yoke comprises:

a yoke body;

a right hooked arm that extends away from the yoke body on a right side; and a left hooked arm that extends away from the yoke body on a left side, wherein the right hooked arm is mounted to the right hub and the left hooked arm is mounted to the left hub.

19. The device of claim 18, wherein the pulley yoke further comprises:

a right yoke shelf formed on the yoke body; and a left yoke shelf on the yoke body, wherein, when the door is closed, the right yoke shelf and the left yoke shelf abut a right yoke wall edge and a left yoke wall edge formed on a right sidewall and a left sidewall, respectively, of the cable recoil device body.

20. The device of claim 13, further comprising:

a cable sheath mounted on a side of the pulley opposite the pulley yoke, wherein the cable sheath comprises a sheath body;

a cable aperture wall formed through sheath body wherein the cable is inserted through the cable aperture wall;

a right sheath head that extends outward from a right side of the sheath body, wherein the right sheath head mounts to a right sidewall of the cable recoil device body; and a left sheath head that extends outward from a left side of the sheath body, wherein the left sheath head mounts to a left sidewall of the cable recoil device body.

* * * * *